US010182614B2

(12) United States Patent
Meschter et al.

(10) Patent No.: US 10,182,614 B2
(45) **Date of Patent: *Jan. 22, 2019**

(54) SOLE SYSTEM HAVING MOVABLE PROTRUDING MEMBERS

(71) Applicant: NIKE, Inc., Beaverton, OR (US)

(72) Inventors: James C. Meschter, Portland, OR (US); Tetsuya T. Minami, Portland, OR (US); Kevin W. Hoffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 9 days.

This patent is subject to a terminal disclaimer.

(21) Appl. No.: 15/249,833

(22) Filed: Aug. 29, 2016

(65) Prior Publication Data

US 2016/0360829 A1 Dec. 15, 2016

Related U.S. Application Data

(62) Division of application No. 14/156,491, filed on Jan. 16, 2014, now Pat. No. 9,516,918.

(51) Int. Cl.

| | |
|---|---|
| ***A43B 13/26*** | (2006.01) |
| ***A43B 13/18*** | (2006.01) |
| ***A43C 15/14*** | (2006.01) |
| ***A43B 13/12*** | (2006.01) |
| ***A43B 13/14*** | (2006.01) |
| ***A43C 15/16*** | (2006.01) |

(52) U.S. Cl.

CPC ..... *A43B 13/184* (2013.01); *A43B 13/12* (2013.01); *A43B 13/141* (2013.01); *A43B 13/18* (2013.01); *A43B 13/185* (2013.01); *A43B 13/188* (2013.01); *A43B 13/26* (2013.01); *A43C 15/14* (2013.01); *A43C 15/161* (2013.01); *A43C 15/167* (2013.01); *A43C 15/168* (2013.01)

(58) Field of Classification Search

CPC ..... A43C 15/168; A43C 15/14; A43B 13/26; A43B 13/24; A43B 13/185

USPC ..... 36/61, 67 R, 67 B, 67 C, 67 D

See application file for complete search history.

(56) References Cited

U.S. PATENT DOCUMENTS

| | | | | |
|---|---|---|---|---|
| 2,061,962 A * | 11/1936 | Gabriele | ..... | A43C 13/04 36/59 R |
| 2,327,360 A | 8/1943 | Meyer | | |
| 2,330,317 A | 9/1943 | Stewart | | |

(Continued)

FOREIGN PATENT DOCUMENTS

| | | |
|---|---|---|
| CA | 2052070 | 1/1993 |
| CN | 102164518 | 8/2011 |

(Continued)

OTHER PUBLICATIONS

Office Action, dated May 2, 2017, for corresponding Chinese Patent Application No. 201480077128.6, 8 pages. No English translation provided.

(Continued)

*Primary Examiner* — Ted Kavanaugh

(74) *Attorney, Agent, or Firm* — Klarquist Sparkman, LLP

(57) ABSTRACT

An article of footwear with a sole system includes a sole member and a protruding member assembly. The sole system provides tactile sensation. Protruding members of the protruding member assembly can translate through holes in the sole member to facilitate tactile sensation.

9 Claims, 26 Drawing Sheets

(56) References Cited

U.S. PATENT DOCUMENTS

| | | | | |
|---|---|---|---|---|
| 2,853,809 | A | 9/1958 | Bianchi | |
| 3,191,321 | A | 6/1965 | Brutting | |
| 3,204,347 | A * | 9/1965 | Snow | A43B 5/06 36/107 |
| 3,328,901 | A * | 7/1967 | Strickland | A43C 15/161 36/127 |
| 3,626,611 | A * | 12/1971 | Bernier | A43C 15/165 264/244 |
| 3,718,996 | A * | 3/1973 | Austin | A43C 15/161 36/102 |
| 3,834,046 | A | 9/1974 | Fowler | |
| 4,085,526 | A * | 4/1978 | Hemmer | A43B 13/26 36/59 R |
| 4,715,133 | A | 12/1987 | Hartjes et al. | |
| 4,747,220 | A | 5/1988 | Autry et al. | |
| 4,798,009 | A | 1/1989 | Colonel | |
| 4,823,799 | A | 4/1989 | Robbins | |
| 5,077,916 | A | 1/1992 | Beneteau | |
| 5,367,791 | A * | 11/1994 | Gross | A43B 13/181 36/25 R |
| 5,595,003 | A | 1/1997 | Snow | |
| 5,607,749 | A | 3/1997 | Strumor | |
| 5,775,005 | A * | 7/1998 | McClelland | A43B 1/0072 36/134 |
| 5,987,781 | A * | 11/1999 | Pavesi | A43B 13/20 36/29 |
| 6,082,024 | A | 7/2000 | Del Biondi | |
| 6,138,281 | A | 10/2000 | Chiaruttini | |
| 6,275,997 | B1 | 8/2001 | Richardson | |
| 6,516,540 | B2 | 2/2003 | Seydel et al. | |
| 6,691,432 | B2 | 2/2004 | Masseron | |
| 6,732,457 | B2 | 5/2004 | Gardiner | |
| 7,013,588 | B2 | 3/2006 | Chang | |
| 7,089,690 | B2 | 8/2006 | Krstic | |
| 7,264,599 | B1 | 9/2007 | Milligan | |
| 7,290,357 | B2 | 11/2007 | McDonald et al. | |
| 7,346,936 | B2 | 3/2008 | Vargas et al. | |
| 7,451,557 | B2 | 11/2008 | McDonald et al. | |
| 7,523,566 | B2 * | 4/2009 | Young-Chul | A43B 13/12 36/28 |
| 7,752,772 | B2 | 7/2010 | Hatfield et al. | |
| 7,849,609 | B2 | 12/2010 | Edington et al. | |
| 7,913,420 | B2 | 3/2011 | Arizumi | |
| 7,918,811 | B2 | 4/2011 | Lussier et al. | |
| 8,006,411 | B2 | 8/2011 | Manz et al. | |
| 8,215,032 | B2 | 7/2012 | Sokolowski et al. | |
| 8,256,145 | B2 | 9/2012 | Baucom | |
| 8,333,022 | B2 | 12/2012 | Crowley, II et al. | |
| 8,387,281 | B2 | 3/2013 | Loverin et al. | |
| 9,516,918 | B2 * | 12/2016 | Meschter | A43B 13/18 |
| 2002/0184793 | A1 | 12/2002 | Sato | |
| 2006/0000119 | A1 | 1/2006 | Endo | |
| 2006/0048413 | A1 | 3/2006 | Sokolowski et al. | |
| 2007/0113425 | A1 * | 5/2007 | Wakley | A43B 13/20 36/28 |
| 2008/0078106 | A1 | 4/2008 | Montgomery | |
| 2009/0056172 | A1 | 3/2009 | Cho | |
| 2009/0083993 | A1 | 4/2009 | Plank | |
| 2010/0077635 | A1 | 4/2010 | Baucom et al. | |
| 2010/0175276 | A1 | 7/2010 | Dojan et al. | |
| 2011/0088287 | A1 * | 4/2011 | Auger | A43B 5/02 36/107 |
| 2011/0192056 | A1 | 8/2011 | Geser | |
| 2011/0252671 | A1 | 10/2011 | Maron et al. | |
| 2011/0277346 | A1 * | 11/2011 | Peyton | A43B 13/20 36/29 |
| 2012/0055047 | A1 | 3/2012 | Youngs | |
| 2012/0167414 | A1 | 7/2012 | Shrairman | |
| 2012/0240432 | A1 | 9/2012 | Lambertz | |
| 2012/0291315 | A1 | 11/2012 | Baucom et al. | |
| 2012/0317843 | A1 | 12/2012 | Bove | |
| 2016/0302523 | A1 | 10/2016 | Fujita et al. | |

FOREIGN PATENT DOCUMENTS

| | | |
|---|---|---|
| DE | 8304272 | 10/1983 |
| DE | 3520956 | 1/1987 |
| DE | 202010017958 | 6/2013 |
| EP | 1557105 | 7/2005 |
| EP | 2494879 | 9/2012 |
| EP | 2594146 | 5/2013 |
| JP | 5-115308 | 5/1993 |
| SU | 971240 | 11/1982 |
| WO | WO 9305674 | 4/1993 |
| WO | WO 2004014171 | 2/2004 |
| WO | WO 2007087581 | 8/2007 |
| WO | WO 2015018593 | 7/2015 |

OTHER PUBLICATIONS

International Preliminary Report on Patentability, dated Jul. 28, 2016, for corresponding International Patent Application No. PCT/US2014/062104.

International Search Report and Written Opinion, dated Nov. 30, 2015, for corresponding International Patent Application No. PCT/US2015/047956.

International Search Report and Written Opinion, dated Oct. 21, 2015, for corresponding International Patent Application No. PCT/US2015/042822.

International Search Report and Written Opinion, dated Jan. 29, 2015, for corresponding International Patent Application No. PCT/US2014/062104.

* cited by examiner

SOLE SYSTEM HAVING MOVABLE PROTRUDING MEMBERS

CROSS REFERENCE TO RELATED APPLICATION

This non-provisional U.S. Patent Application is a divisional of and claims priority under 35 U.S.C. 121 to U.S. application Ser. No. 14/156,491 entitled "Sole System Having Movable Protruding Members," filed on Jan. 16, 2014, which published as U.S. Patent Application Publication Number US 2015/0196087 on Jul. 16, 2015 and was allowed on Aug. 12, 2016, the disclosure of which application is hereby incorporated by reference in its entirety.

BACKGROUND

The present embodiments relate to articles of footwear and in particular to a sole system for articles of footwear.

Athletic shoes often have two major components, an upper that provides the enclosure for receiving the foot, and a sole secured to the upper. The upper may be adjustable using laces, hook-and-loop fasteners or other devices to secure the shoe properly to the foot. The sole has the primary contact with the playing surface. The sole may be designed to absorb the shock as the shoe contacts the ground or other surfaces. The upper may be designed to provide the appropriate type of protection to the foot and to maximize the wearer's comfort.

SUMMARY

In one aspect an article of footwear includes a sole member having an outwardly facing surface and an inwardly facing surface disposed opposite of the outwardly facing surface, where the outwardly facing surface is disposed further from a foot than the inwardly facing surface when the article of footwear is worn. The sole member includes a hole extending from the outwardly facing surface to the inwardly facing surface. The article of footwear includes at least one protruding member including a proximal end portion and a distal end portion, where the distal end portion is disposed further from the foot than the proximal end portion when the article of footwear is worn. A portion of the at least one protruding member is disposed within the hole of the sole member. The at least one protruding member has a first position where the proximal end portion of the at least one protruding member is disposed a first distance from the inwardly facing surface of the sole member. The at least one protruding member has a second position where the proximal end portion of the at least one protruding member is disposed a second distance from the inwardly facing surface of the sole member and where the at least one protruding member extends away from the sole member in the second position. The proximal end portion is disposed closer to the inner surface of the sole member than the distal end portion when the at least one protruding member is in the first position and the second distance is greater than the first distance.

In another aspect, an article of footwear includes a sole member having an outwardly facing surface and an inwardly facing surface disposed opposite of the outwardly facing surface, where the outwardly facing surface is disposed further from a foot than the inwardly facing surface when the article of footwear is worn. The article of footwear includes a protruding member assembly including a first protruding member and a second protruding member. The protruding member assembly further includes a connecting portion including a first end portion attached to the first protruding member and a second end portion attached to the second protruding member. The sole member including a first hole and a second hole. The first protruding member extends through the first hole and the second protruding member extends through the second hole. The connecting portion is disposed on the inwardly facing surface of the sole member. The connecting portion allows the first protruding member to move a first distance while the second protruding member moves a second distance, and the first distance is greater than the second distance.

In another aspect, an article of footwear includes a sole member having an outwardly facing surface and an inwardly facing surface disposed opposite of the outwardly facing surface, where the outwardly facing surface is disposed further from a foot than the inwardly facing surface when the article of footwear is worn. The sole member has a vertical direction that extends between the outwardly facing surface and the inwardly facing surface. A protruding member assembly includes a plurality of protruding members connected together by a plurality of connecting portions. The plurality of protruding members further include proximal end portions that provide an inner surface for the protruding member assembly and the plurality of protruding members include distal end portions that provide an outer surface for the protruding member assembly. The sole member includes a plurality of holes to receive the plurality of protruding members such that the distal end portions of the plurality of protruding members extend away from the outwardly facing surface. The plurality of protruding members can move relative to the sole member in the vertical direction and the geometry of the inner surface of the protruding member assembly changes as the plurality of protruding members move in response to forces applied to the outer surface of protruding member assembly.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
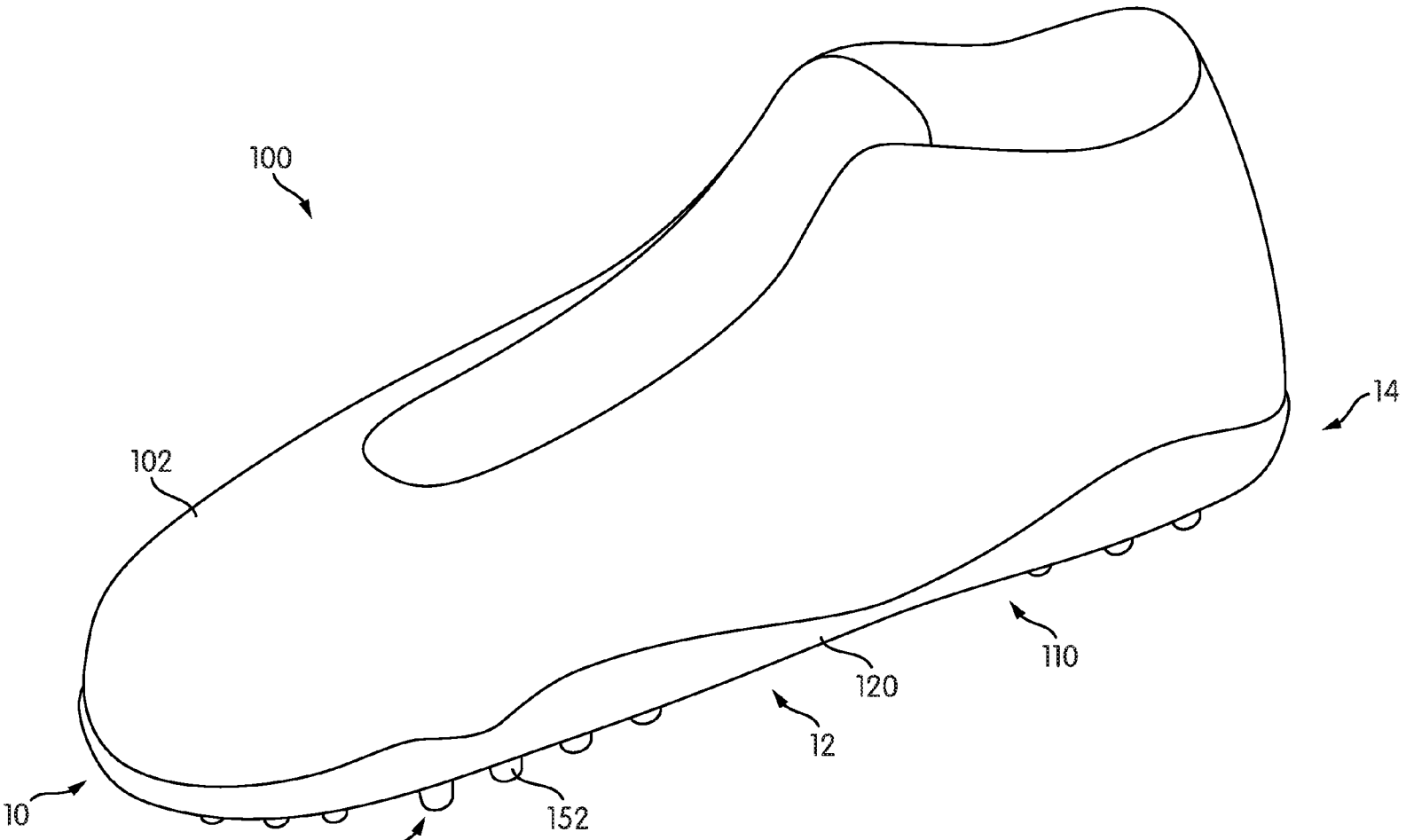
FIG. 1 is an isometric view of an embodiment of an article of footwear.

FIG. 1 is an isometric view of an embodiment of an article of footwear 100, also referred to simply as article 100. Article 100 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear, apparel and/or sporting equipment (e.g., gloves, helmets, etc.).

In some embodiments, article of footwear 100 may include upper 102 and sole system 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper. In some embodiments, upper 102 could further include provisions for fastening article 100 to a foot, such as a lacing system (not shown) and may include still other provisions found in footwear uppers.

Sole system 110 is secured to upper 102 and extends between the foot and the ground when article 100 is worn. In different embodiments, sole system 110 may include different components. For example, sole system 110 may include an outsole, a midsole, and/or an insole. In some cases, one or more of these components may be optional.

Sole system 110 may provide one or more functions for article 100. For example, in some embodiments, sole system 110 may be configured to provide traction for article 100. In addition to providing traction, sole system 110 may attenuate ground reaction forces when compressed between the foot and the ground during walking, running or other ambulatory activities. The configuration of sole system 110 may vary significantly in different embodiments to include a variety of conventional or non-conventional structures. In some cases, the configuration of sole system 110 can be selected according to one or more types of ground surfaces on which sole system 110 may be used. Examples of ground surfaces include, but are not limited to: natural turf, synthetic turf, dirt, as well as other surfaces.

As described in further detail below, in some embodiments, sole system 110 may also include provisions to enhance tactile sensation at the sole of the foot. For example, sole system 110 can include features that provide a tactile response to variations in a ground surface.

Figure 2:
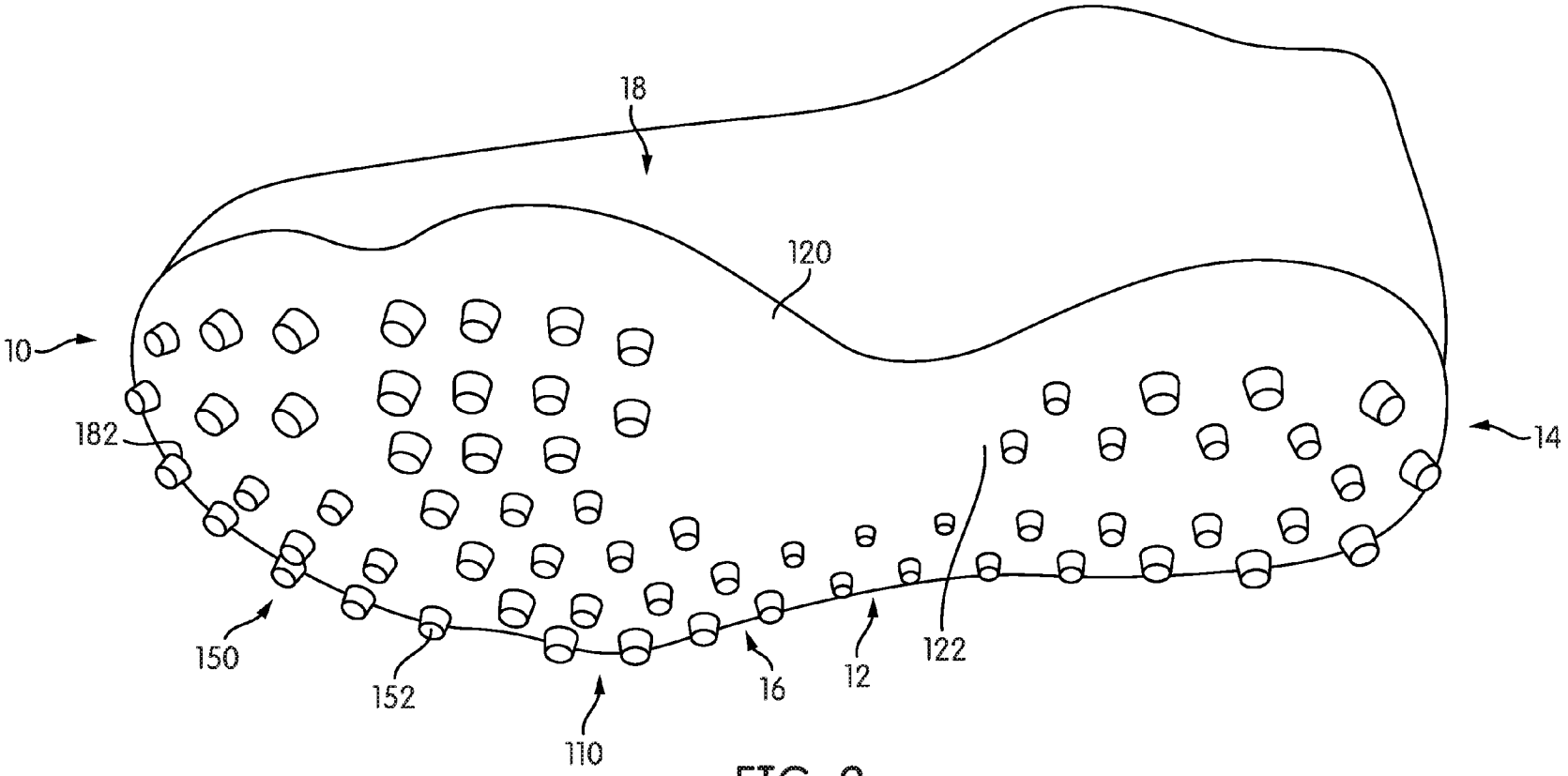
FIG. 2 is a bottom isometric view of an embodiment of an article of footwear, in which a sole system of the article is visible.

Referring to FIG. 1, for purposes of reference, sole system 110 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, sole system 110 may include lateral side 16 and medial side 18 (see FIG. 2). In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of sole system 110. Likewise, lateral side 16 and medial side 18 are intended to represent generally two sides of sole system 110, rather than precisely demarcating system 110 into two halves.

For consistency and convenience, directional adjectives are employed throughout this detailed description corresponding to the illustrated embodiments. The term "longitudinal" as used throughout this detailed description and in the claims refers to a direction extending a length of a component. For example, the longitudinal direction of sole system 110 may extend from forefoot portion 10 to heel portion 14 of sole system 110. Also, the term "lateral" as used throughout this detailed description and in the claims refers to a direction extending along a width of a component. For example, the lateral direction of sole system 110 may extend between medial side 18 and lateral side 16 of sole system 110. Additionally, the term "vertical" as used throughout this detailed description and in the claims refers to a direction that is perpendicular to both the longitudinal and lateral directions. For example, the vertical direction of sole system 110 may extend through the thickness of sole system 110.

In addition, the term "proximal" refers to a portion of a footwear component that is closer to a portion of a foot when an article of footwear is worn. Likewise, the term proximal direction refers to a direction oriented towards a foot when an article is word. The term "distal" refers to a portion of a footwear component that is further from a portion of a foot when an article of footwear is worn. The distal direction refers to a direction oriented away from a foot when an article is worn.

In some embodiments, sole system 110 may further include a sole member 120 and a protruding member assembly 150. In some embodiments, protruding member assembly 150 may comprise a plurality of protruding portions 152, as well as a plurality of connecting portions (not shown in FIG. 1). In some embodiments, sole member 120 may be adapted to receive protruding member assembly 150, as described in further detail below.

Figure 3:
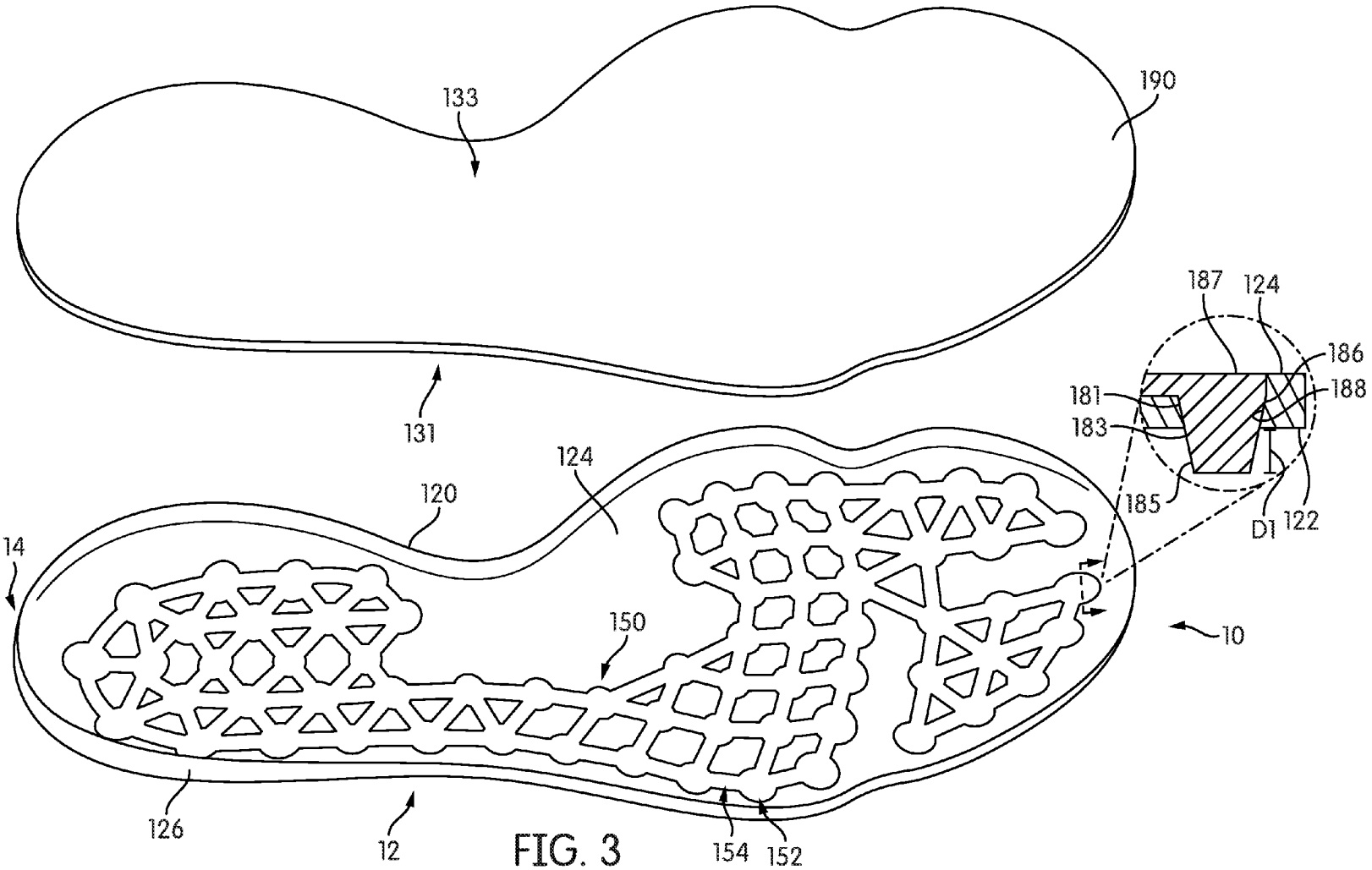
FIG. 3 is an isometric view of an embodiment of a sole member and an inner member.
Figure 22:
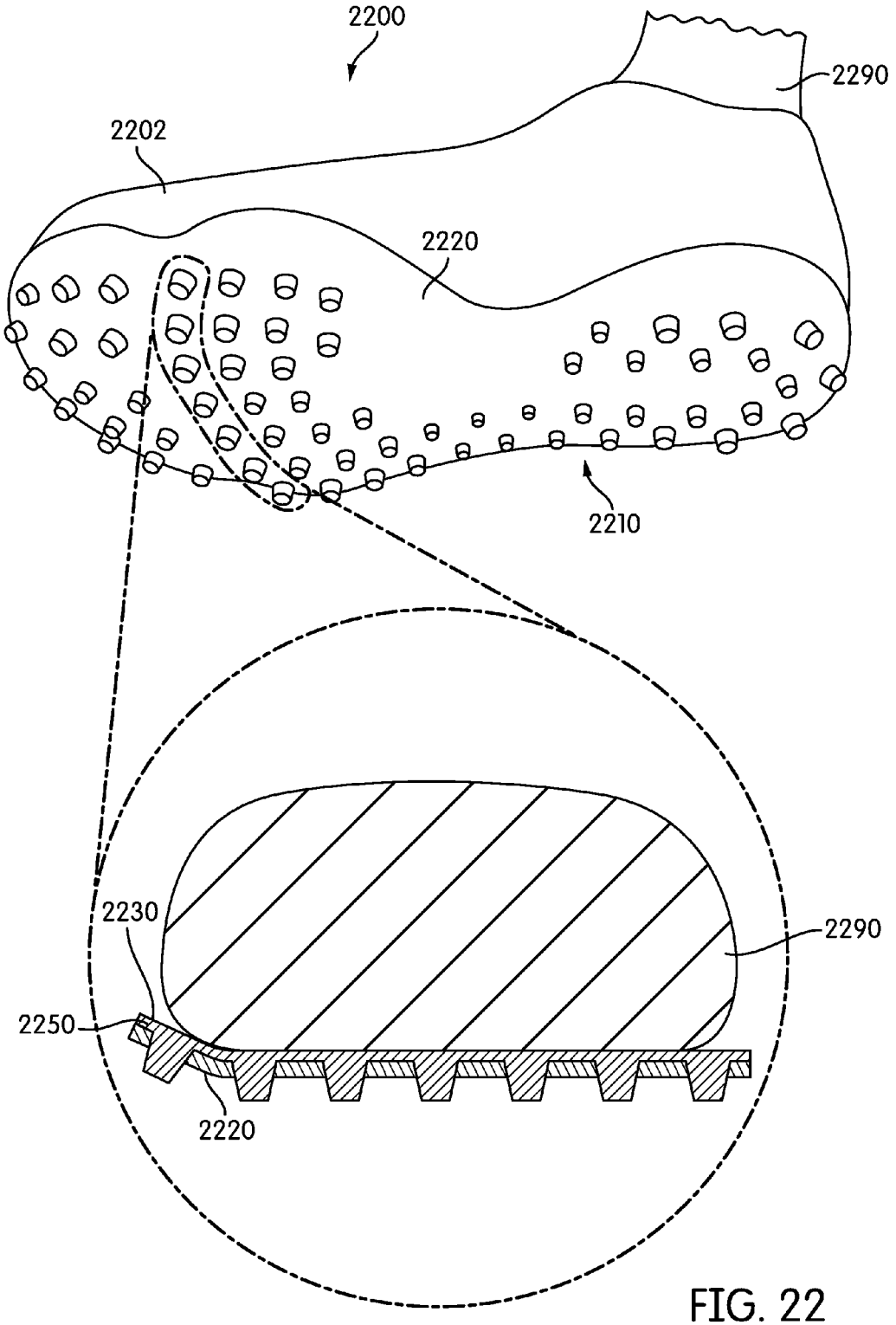
FIG. 22 is an isometric view of another embodiment of a sole system, in which a protruding member assembly may be disposed directly against a foot.

FIGS. 2 through 6 illustrate various views of an embodiment of some possible components of sole system 110. These components may include sole member 120 and protruding member assembly 150. In some embodiments, sole system 110 may optionally include an inner member 190, which is shown in FIG. 3. For purposes of illustration, inner member 190 is not shown in all of the figures. FIG. 22, which is described in further detail below, depicts an alternative embodiment in which a protruding member assembly 150 may be configured to contact a foot directly.

In different embodiments, inner member 190 could be configured as a variety of different footwear components including, but not limited to: an insole or a sockliner. Thus, inner member 190 may be configured to provide enhanced support for a foot as well as increased cushioning and comfort. In some embodiments, inner member 190 may be primarily associated with sole system 110 (e.g., inner member 190 may be an insole). In other embodiments, inner member 190 may be primarily associated with upper 102 (e.g., inner member 190 may be a part of a sockliner). In some embodiments, inner member 190 could comprise all or part of a slip last or strobel.

In some embodiments, inner member 190 may be a full length member, which extends from a forefoot portion 10 to a heel portion 14 of sole system 110. In other embodiments, however, inner member 190 could be a partial length member that extends through some portions of sole system 110, but not others. As one example, in another embodiment, inner member 190 could extend through only forefoot portion 10. In another embodiment, inner member 190 could extend through only heel portion 14.

When used, inner member 190 may be disposed between a foot and other components of sole system 110, including both sole member 120 and protruding member assembly 150. In some embodiments, for example, a first surface 131 of inner member 190 confronts sole member 120 and protruding member assembly 150 while a second surface 133 of inner member 190 faces towards a foot and/or additional layers such as a strobel or other liner. In some cases, second surface 133 may directly contact a foot during use.

In some embodiments, sole member 120 may be configured as a midsole and/or outsole of sole system 110. In the exemplary embodiment, sole member 120 comprises a monolithic or unitary structure that provides support and strength, as well as a durable outer ground engaging surface for sole system 110. Optionally, in other embodiments, sole member 120 could comprise a separate midsole and outsole. As an example, in another embodiment, sole member 120 could be further covered on a lower surface by a separate outsole, which further includes holes to receive protruding members.

In some embodiments, sole member 120 may be characterized as having an outwardly facing surface 122 (as shown, for example, in FIG. 2) and an inwardly facing surface 124 (as shown, for example, in FIG. 3) that is disposed opposite of outwardly facing surface 122. Outwardly facing surface 122 may be a ground facing, or ground engaging, surface. In contrast, inwardly facing surface 124 may be disposed closer to a foot than outwardly facing surface 122. Inwardly facing surface 124, in some embodiments, may confront inner member 190. It will be understood that outwardly facing surface 122 and inwardly facing surface 124 may optionally be characterized as a distal surface and a proximal surface, respectively. In addition, sole member 120 includes a sidewall surface 126 that extends between outwardly facing surface 122 and inwardly facing surface 124, which is oriented approximately in the vertical direction.

In some embodiments, protruding member assembly 150 may comprise plurality of protruding members 152 that are connected to one another by a plurality of connecting portions 154. As used throughout this detailed description and in the claims, the term "protruding member" refers to any component or structure that can protrude outwardly from a surface of a sole system. In some embodiments, a protruding member may be a cleat member or other traction element that is configured to engage a ground surface and provide increased traction between sole member 120 and a ground surface. However, in other embodiments a protruding member may not be configured to facilitate ground engagement and/or traction. Instead, it is possible that in some embodiments a protruding member may be primarily utilized to enhance tactile sensation, as discussed in further detail below. In an exemplary embodiment, each protruding member of plurality of protruding members 152 may be configured as a cleat member that improves traction and also facilitates enhanced tactility and sensation on the bottom of the foot.

Figure 5:
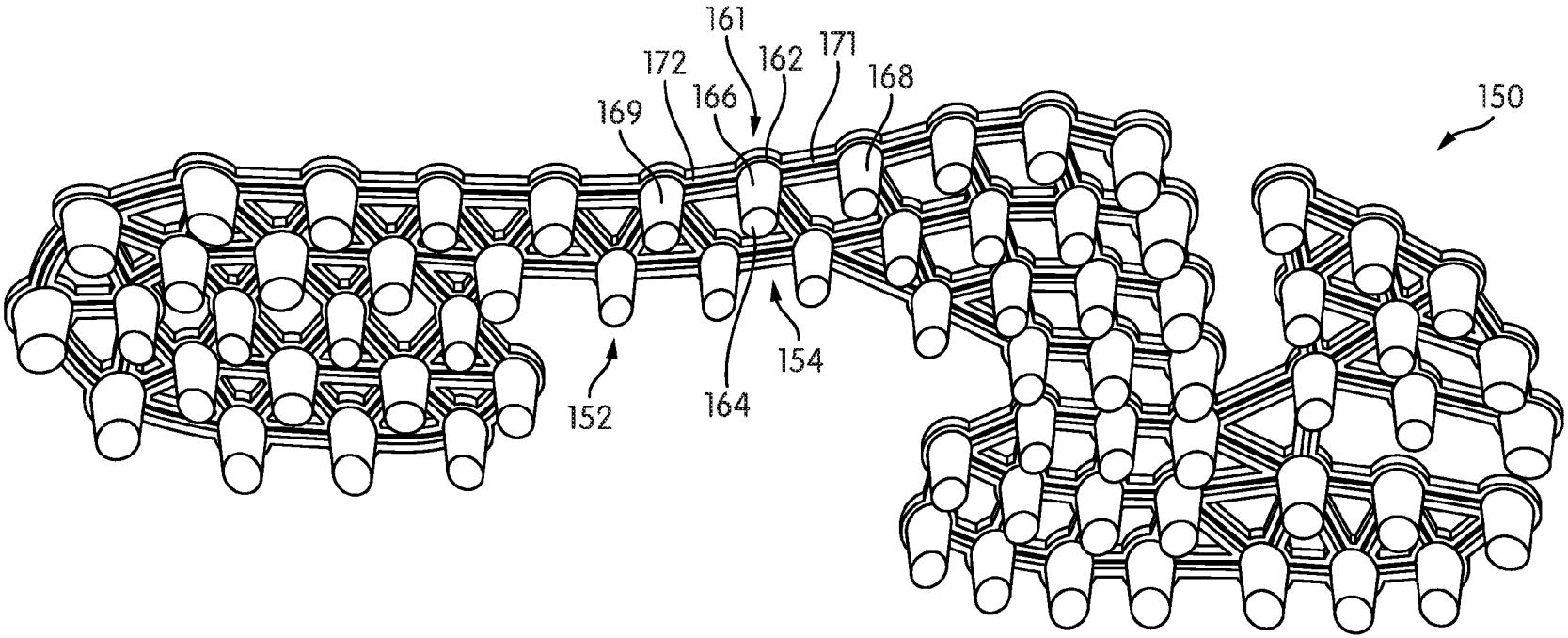
FIG. 5 is a bottom isometric view of an embodiment of a protruding member assembly.

Each protruding member may be characterized as having a first end portion (or proximal portion), a second end portion (or distal portion) and an intermediate portion. For example, as indicated in FIG. 5, a first protruding member 161 of plurality of protruding members 152 may have a proximal end portion 162, a distal end portion 164 and an intermediate portion 166 that is disposed between proximal end portion 162 and distal end portion 164. In some embodiments, a distal end portion of each protruding member may be configured to contact a ground surface. As an example, distal end portion 164 of first protruding member 161 may be configured to contact a ground surface. Thus, in some cases, distal end portion 164 may function as a cleat tip. In contrast, a proximal end portion of each protruding member can be in direct contact with a foot, or in indirect contact with a foot (e.g., via an inner member), thereby allowing the foot to interact with the protruding members in the manner discussed below. For example, in the exemplary embodiment, proximal end portion 162 of first protruding member 161 may be configured to interact with a foot.

In some embodiments, plurality of protruding members 152 may be connected to one another using plurality of connecting portions 154. More specifically, in some embodiments, protruding members that are directly adjacent may be connected by a connecting portion. For example, in the exemplary embodiment, first protruding member 161 and an adjacent second protruding member 168 are connected to one another by first connecting portion 171. Further, each protruding member of plurality of protruding members 152 may be connected to one or more protruding members that are directly adjacent to the protruding member. For example, first protruding member 161 is also connected to a third protruding member 169 by second connecting portion 172. This arrangement provides a matrix-like or web-like configuration for protruding member assembly 150.

Figure 6:
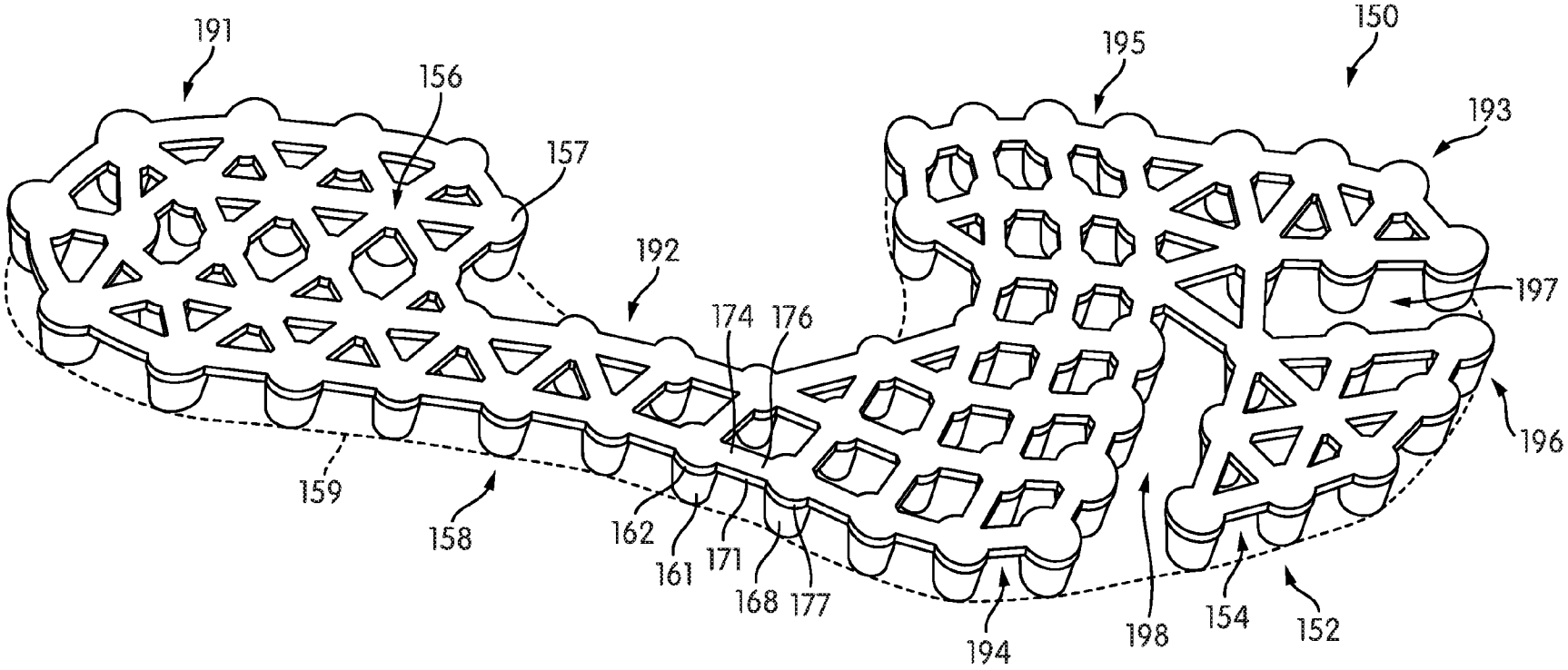
FIG. 6 is a top down isometric view of an embodiment of a protruding member assembly.

In some embodiments, plurality of connecting portions 154 may each include a first end portion and a second end portion. For example, as indicated in FIG. 6, first connecting portion 171 includes a first end portion 174 and a second end portion 176 that are connected to first protruding member 161 and second protruding member 168, respectively. In some embodiments, first end portion 174 and second end portion 176 connect to proximal end portion 162 of first protruding member 161 and proximal end portion 177 of second protruding member 168, respectively. Likewise, the remaining connecting portions of plurality of connecting portions 154 may also connect adjacent protruding members along their respective proximal end portions. In still other embodiments, however, adjacent protruding members could be connected to one another at their respective intermediate portions. Such a configuration is described below and shown in FIGS. 16-20. Of course, it is possible that in still other embodiments, adjacent protruding members could be connected to one another at their respective distal end portions. Moreover, it is also possible that in other embodiments protruding members could be connected at multiple portions simultaneously (e.g., connected along both the proximal portions and intermediate portions simultaneously).

Figure 4:
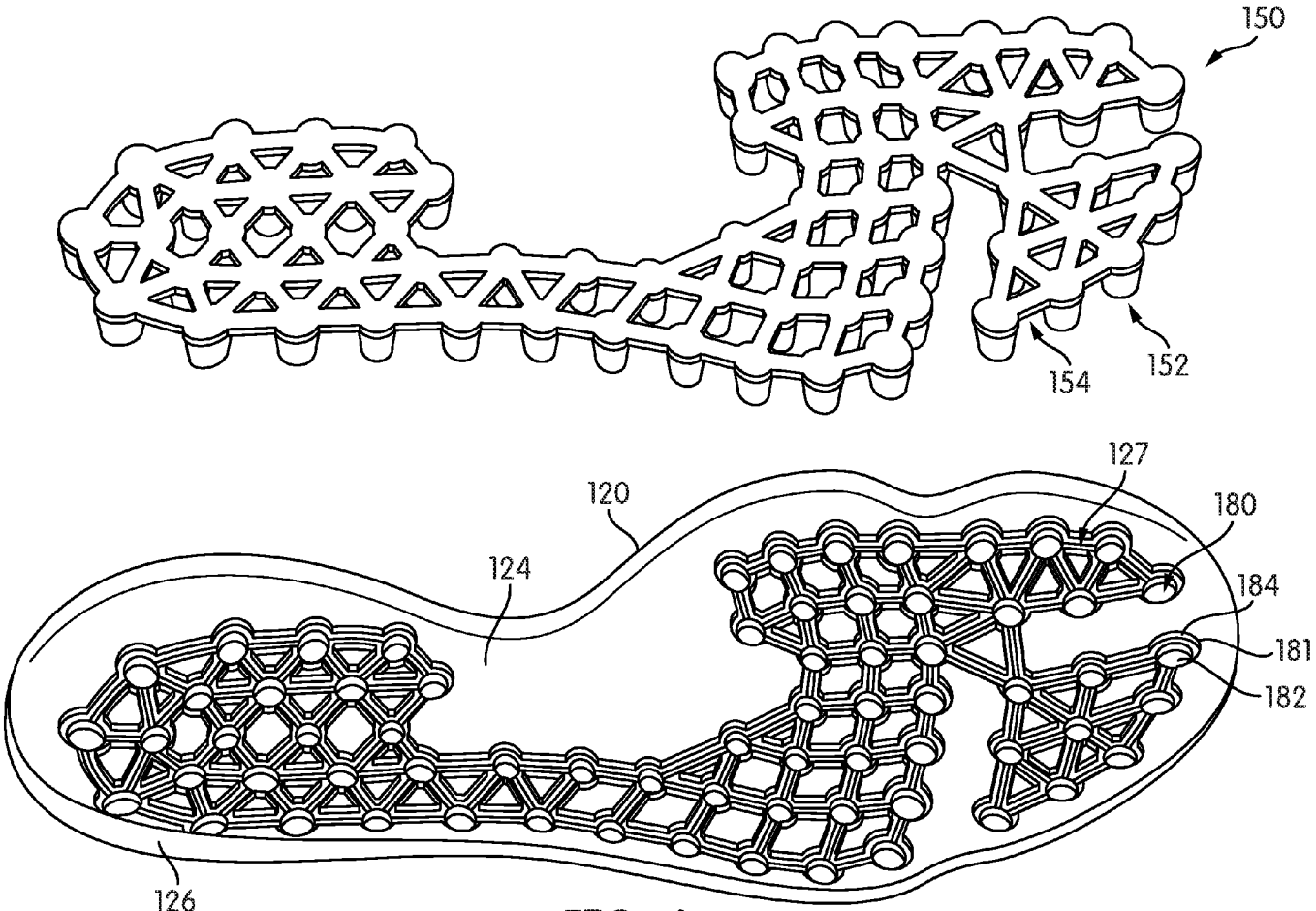
FIG. 4 is an isometric exploded view of an embodiment of a sole member and a corresponding protruding member assembly.

Referring now to FIG. 4, sole member 120 may include provisions to receive protruding member assembly 150. In some embodiments, sole member 120 includes a plurality of holes 180 that are configured to receive corresponding protruding members from plurality of protruding members 152. In some embodiments, plurality of holes 180 extend through the entire thickness of sole member 120. In other words, each hole of plurality of holes 180 extends from outwardly facing surface 122 to inwardly facing surface 124. As an example, a first hole 181 includes a first end 182 (see also FIG. 2) that is open on outwardly facing surface 122 and a second end 184 that is open on inwardly facing surface 124.

In order for protruding member assembly 150 to be assembled with sole member 120, plurality of holes 180 are arranged in a configuration on sole member 120 that corresponds to the arrangement of plurality of members 152 within protruding member assembly 150. In particular, plurality of holes 180 are in one-to-one correspondence with plurality of protruding members 152 so that each protruding member is received in a corresponding hole. Thus, the pattern or arrangement of plurality of holes 180 within sole member 120 is seen to match the pattern or arrangement of plurality of protruding members 152 within protruding member assembly 150.

In some embodiments, inwardly facing surface 124 may include provisions to receive one or more connecting portions. For example, in some embodiments, inwardly facing surface 124 includes a plurality of recesses 127 that are sized and oriented to fit corresponding connecting portions of plurality of connecting portions 154. As seen in FIG. 4, plurality of recesses 127 form a pattern on sole member 120 that matches the pattern of connecting portions 154 within protruding member assembly 150. In some embodiments, plurality of recesses 127 may be deep enough so that plurality of connecting portions 154 are flush with, or recessed within, inwardly facing surface 124. In other embodiments, plurality of recesses 126 may be shallow so that some portions of connecting portions 154 are raised above inwardly facing surface 124.

Using the exemplary configuration, protruding member assembly 150 may be assembled with sole member 120 so that plurality of protruding members 152 are inserted through plurality of holes 180. Further, in some cases, plurality of connecting portions 154 are received within plurality of recesses 127 of inwardly facing surface 124. With this configuration, plurality of connecting portions 154 may form a supporting structure along inwardly facing surface 124 from which plurality of protruding members 152 may be suspended. This arrangement facilitates the articulation of individual protruding members as discussed in further detail below.

Referring now to FIG. 6, for purposes of description, protruding member assembly 150 may be characterized by an inner portion 156 and an outer portion 158. Inner portion 156 includes all the proximal end portions of plurality of protruding members 152 as well as plurality of connecting portions 154. In other words, inner portion 156 may comprise the portion of protruding member assembly 150 that is disposed closest to a foot when article 100 is worn.

Outer portion 158 includes all the distal end portions of plurality of protruding members 152. In other words, outer portion 158 may comprise the portion of protruding member assembly 150 that confronts a ground surface during use. In some cases, inner portion 156 may be further associated with an inner surface 157 that is approximately parallel with the top surfaces of the proximal end portions of plurality of protruding members 152 and with the top surfaces of plurality of connecting portions 154. Likewise, in some cases, outer portion 158 may be further associated with an outer surface 159. Outer surface 159 may be a two-dimensional surface that is approximately parallel with the bottom surfaces of the distal end portions of plurality of protruding members 152. As seen in FIGS. 5 and 6, both inner surface 157 and outer surface 159 are discontinuous surfaces.

As seen in the figures, when protruding member assembly 150 is assembled with sole member 120, plurality of protruding members 152 extend through plurality of holes 180. Moreover, the distal end portions of each protruding member extend outwardly from outwardly facing surface 122 of sole member 120. For example, in the configuration shown in FIG. 3, a distal portion 185 of a protruding member 183 extends a distance D1 from outwardly facing surface 122.

Similarly, each of the remaining protruding members may extend outwardly from outwardly facing surface 122. In some cases, each protruding member may extend a similar distance from outwardly facing surface 122. In other embodiments, however, two or more different protruding members can extend different distances from outwardly facing surface 122. Furthermore, as discussed in detail below, the extent to which each protruding member extends from a corresponding hole may vary as sole system 110 comes into contact with a ground surface.

In some embodiments, the proximal end portions of each protruding member of plurality of protruding members 152 could be flush with, or extend outwardly from, inwardly facing surface 124 of sole member 120. As best seen in FIG. 3, in the exemplary embodiment, each protruding member is approximately flush with inwardly facing surface 124. For example, an end portion 187 of protruding member 183 is approximately flush with inwardly facing surface 124. However, in other embodiments, at least some protruding members may extend outwardly from inwardly facing surface 124. In other words, in some embodiments, the proximal end portions of some protruding members of plurality of protruding members 152 could be raised with respect to inwardly facing surface 124. It is also contemplated that in some embodiments, the proximal end portions of some protruding members could be recessed with respect to inwardly facing surface 124. As discussed in further detail below, the relative distance of each proximal end portion of plurality of protruding members 152 from inwardly facing surface 124 may vary as sole system 110 comes into contact with a ground surface.

FIG. 3 further illustrates one possible arrangement for sole system 110, in which each protruding member may confront, or be disposed directly adjacent to, an interior surface of a corresponding hole. For example, in the current embodiment, protruding member 183 includes an exterior surface 186 that confronts an interior surface 188 of hole 181. Although this embodiment shows a relatively snug fit between protruding member 183 and hole 181, in other embodiments some or all of exterior surface 186 could be spaced apart from interior surface 188 of hole 181. Thus, in some other embodiments, protruding member 183 could "float" within a hole 181 and be suspended by adjacent connecting portions.

In different embodiments, the arrangements of protruding member assembly 150 through sole member 120 can vary. For example, in some embodiments, protruding member assembly 150 may extend through all portions of sole member 120 (e.g., forefoot portion 10, midfoot portion 12 and heel portion 14). In other embodiments, protruding member assembly 150 may extend through some portions of sole member 120, but not others. As an example, in some embodiments, protruding member assembly 150 could be associated with forefoot portion 10 and midfoot portion 12, but not heel portion 14. In still other embodiments, protruding member assembly 150 could extend through any other portions or combination of portions.

In different embodiments, the geometric pattern formed by plurality of protruding members 152 and connecting portions 154 could vary. For example, the relative spacing between adjacent protruding members, the number of connecting portions attached to each protruding member as well as other general geometric features of the arrangement could be varied. These geometric features could be selected to achieve desired levels of tactile sensation across different regions of the foot.

In an exemplary embodiment, protruding member assembly 150 extends through a majority of sole member 120, with some gaps in coverage. For example, as best seen in FIG. 6, protruding member assembly 150 includes a heel portion 191 and a forefoot portion 193. Heel portion 191 and forefoot portion 193 are connected by a lateral arch portion 192, and spaced apart on a medial side of sole member 120. Further, forefoot portion 193 includes a rear forefoot portion 194, a medial forefoot portion 195 and a lateral forefoot portion 196. A first gap 197 separates a portion of lateral forefoot portion 196 from medial forefoot portion 195. In addition, a second gap 198 separates a portion of lateral forefoot portion 196 from rear forefoot portion 194. This particular arrangement may be used to achieve tactile sensation in both the forefoot and heel. Additionally, gaps between adjacent portions of protruding member assembly 150 (such as gap 197 between medial forefoot portion 195 and lateral forefoot portion 196) may help a user to better distinguish between tactile stimulation in different parts of the foot.

Although the current embodiment illustrates a unitary protruding member assembly, other embodiments could comprise a protruding member assembly with disjoint sections, or multiple protruding member assemblies that are separated. Such an example is discussed below and illustrated in FIGS. 16-20.

Embodiments may incorporate protruding members of different shapes and/or sizes. In one exemplary embodiment, plurality of protruding members 152 each have a geometry that is approximated by a conical frustum (e.g., a truncated cone). In other words, the diameter of each protruding member of plurality of protruding members 152 may decrease towards the tips (i.e., in the distal direction). In another exemplary embodiment, discussed below, a plurality of protruding members may have a cylindrical geometry (i.e., constant diameter). Such an embodiment is described below and shown in FIGS. 16-20. Furthermore, other embodiments could incorporate protruding members having any other geometries and/or sizes, including a variety of geometries commonly associated with cleats and traction elements for footwear.

In different embodiments, the dimensions of each protruding member could vary. For example, in some embodiments the diameter of a protruding member could be substantially greater than a height of the protruding member. In other embodiments, the height of a protruding member could be substantially less than the height of the protruding member. It is contemplated that some embodiments could utilize protruding members having a pin-like geometry in which the length of the protruding member is much greater than the diameter. In other embodiments, the diameter and height of a protruding member could be substantially similar. The dimensions (e.g., diameter and/or height) could be selected according to factors including, but not limited to, materials used, desired tactile properties and user comfort.

In different embodiments, the geometry of one or more connecting portions could also vary. In the exemplary embodiment, each connecting portion has a strip-like or bar-like shape. In other embodiments, however, the geometry of each connecting portion could vary in any other manner. Other exemplary geometries could include straight geometries, curved geometries as well as regular and irregular geometries.

It will be understood that embodiments may utilize a variety of different geometries for one or more holes within sole member 120. Exemplary embodiments include hole geometries that correspond to the geometries of associated protruding members. For example, as seen in FIG. 3, hole 181 has a conical or tapered geometry to fit the matching geometry of protruding member 183. In some cases, the hole geometry could differ from the corresponding protruding member geometry. For example, some embodiments may utilize cylindrical holes with constant diameters for cleats having a conical frustum (or otherwise tapered) geometry. Furthermore, the size and geometry of a hole can be varied to achieved either a snug or loose fit with an associated protruding member.

In some embodiments, protruding member assembly 150 may be configured in a manner that allows the assembly to flex, bend, deflect, twist or otherwise undergo elastic deformation of some kind. This can be achieved through the use of connecting portions that are at least partially elastic and therefore allow for some relative movement between adjacent protruding members.

In embodiments where a large number of protruding members are connected via a matrix or webbing of connecting portions, even small local deformations of connecting portions can result in large global deformations for protruding member assembly 150. In embodiments where large deformations of connecting portions can occur, the resultant global deformations in protruding member assembly 150 can be large.

Figure 7:
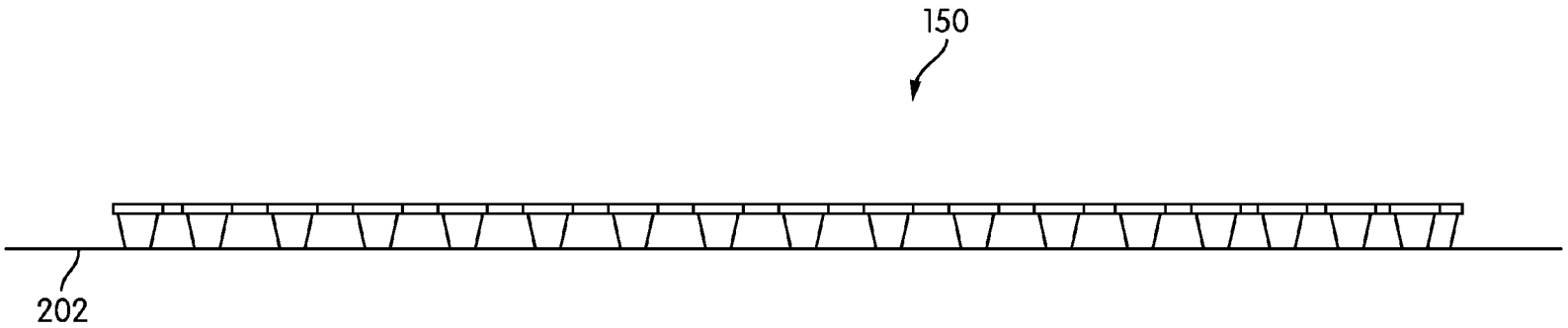
FIG. 7 is a side schematic view of an embodiment of a protruding member assembly in a flattened configuration.
Figure 8:
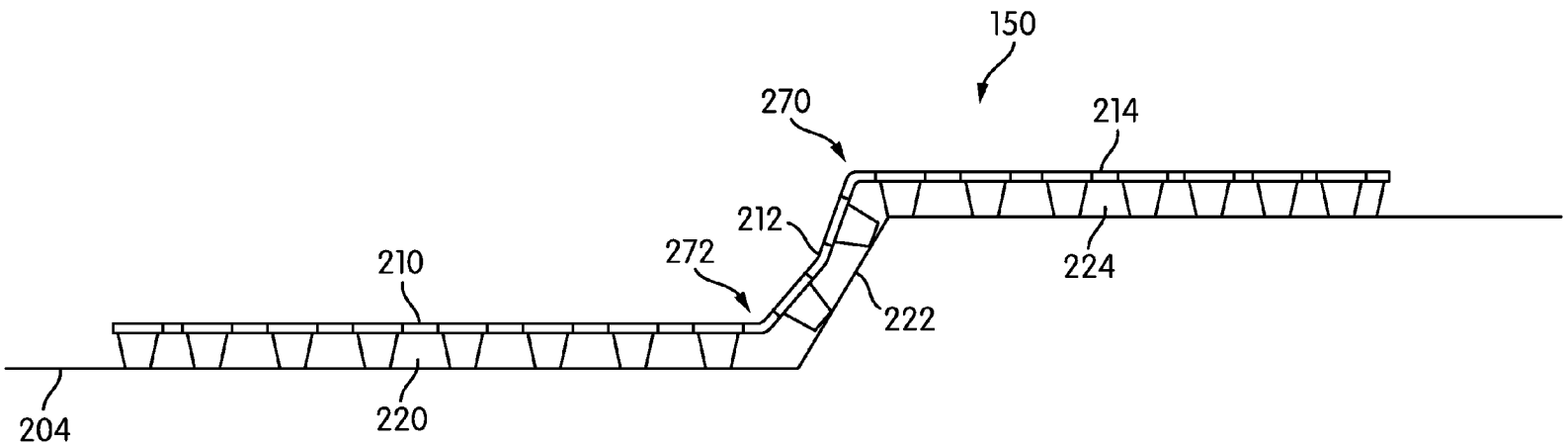
FIG. 8 is a side schematic view of an embodiment of a protruding member assembly bent in a manner to conform to a stepped surface.
Figure 9:
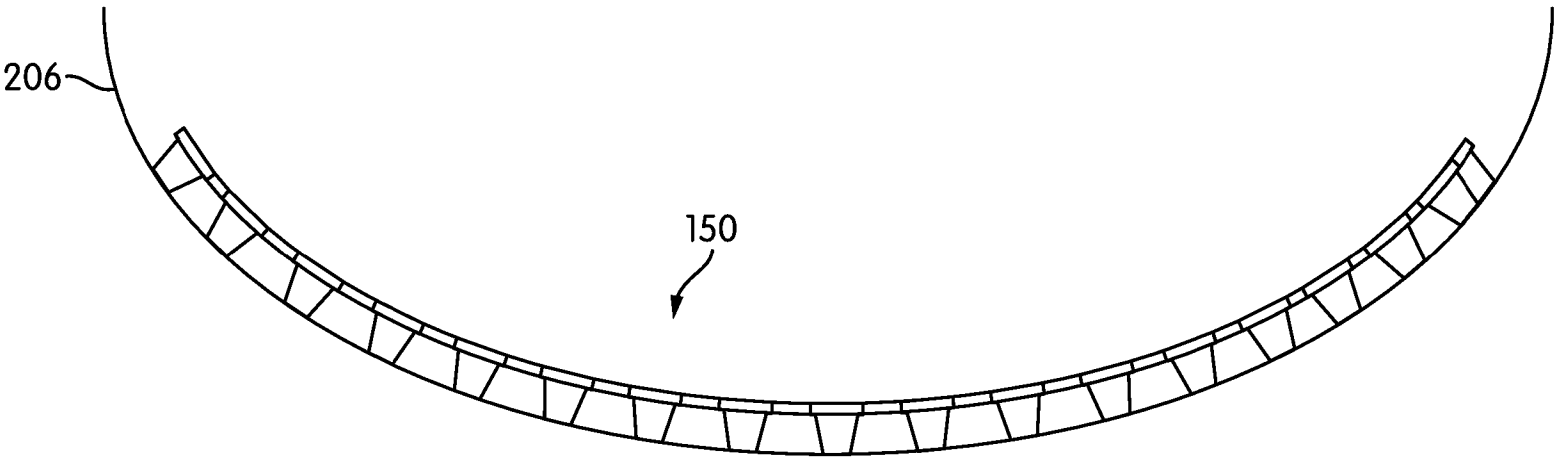
FIG. 9 is a side schematic view of an embodiment of a protruding member assembly flexing in a manner to conform to a concave surface.

FIG. 7 illustrates an embodiment of protruding member assembly 150 in a flattened state, while FIGS. 8 and 9 illustrate protruding member assembly 150 in different states of bending and flexing. For purposes of illustration, protruding member assembly 150 is shown schematically. Referring first to FIG. 7, when placed on a flat surface 202, protruding member assembly 150 takes on an approximately flat global geometry. However, as seen in FIGS. 8 and 9, when protruding member assembly 150 is placed on contoured or irregular surfaces, the geometry of protruding member assembly 150 changes to accommodate (or match) the geometry of the surface. Referring to FIG. 8, protruding member assembly 150 is seen to adapt to the geometry of stepped surface 204. Here, a first region 210 of protruding member assembly 150 is parallel with a lower step 220 of stepped surface 204. Likewise, a second region 212 of protruding member assembly 150 is parallel with a sloped portion 222 of stepped surface 204. Finally, a third region 214 of protruding member assembly 150 is parallel with an upper step 224 of stepped surface 204. This stepped geometry for protruding member assembly 150 is achieved via large elastic deformations of connecting portions at a first region 270 and a second region 272.

Referring now to FIG. 9, protruding member assembly 150 is seen to conform to the concave geometry of concave surface 206. In contrast to the previous configuration that included regions of large bending, the geometric configuration illustrated in FIG. 9 for protruding member assembly 150 is achieved as the combined result of many small deformations between adjacent protruding members.

Thus, it is clear that protruding member assembly 150 can be bent or flexed such that adjacent regions of protruding member assembly 150 are angled or non-parallel with each other. Likewise, protruding member assembly 150 can be elastically deformed into curved and/or non-linear geometries.

Figure 10:
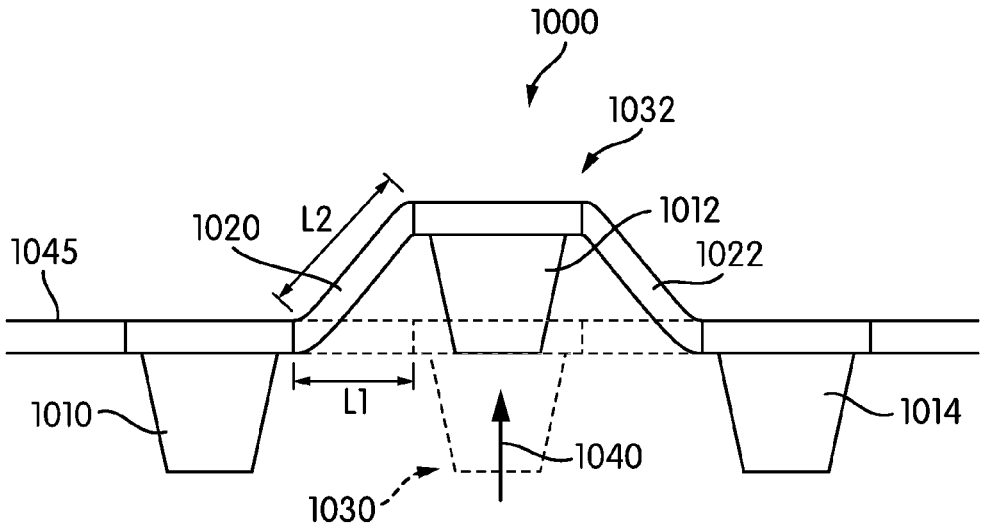
FIG. 10 is a side schematic view of an embodiment of a portion of a protruding member assembly in which a protruding member has been moved to an engaged position.

FIG. 10 is a schematic side view of an embodiment of a portion of a protruding member assembly 1000, which is intended to illustrate local flexing of protruding member assembly 1000. Referring to FIG. 10, first protruding member 1010 and second protruding member 1012 are connected by first connecting portion 1020. Likewise, second protruding member 1012 and third protruding member 1014 are separated by second connecting portion 1022. Here, second protruding member 1012 has been displaced from an initial position 1030 (shown in phantom) to a displaced position 1032 by a force 1040. Such a force could be, for example, a local surface feature of the ground that engages and pushes up against second protruding member 1012 but that does not contact and press on first protruding member 1010 or third protruding member 1014.

As seen here, the displacement of second protruding member 1012 is made possible by the elastic properties of first connecting portion 1020 and second connecting portion 1022, which may stretch or otherwise elastically deform in response to applied forces. For example, first connecting portion 1020 is seen to stretch from an initial length L1 to a final length L2. Second connecting portion 1022 may likewise undergo stretching as the position of second protruding member 1012 is changed.

Further, it can be seen that as second protruding member 1012 is displaced, the orientations of first connecting portion 1020 and second connecting portion 1022 change. In particular, first connecting portion 1020 and second connecting portion 1022 may be approximately flat or parallel with an inner surface 1045 of protruding member assembly 1000 while second protruding member 1012 is in the initial position 1030. However, as second protruding member 1012 is moved to the displaced position 1032, first connecting portion 1020 and second connecting portion 1022 become angled with respect to inner surface 1045.

While the exemplary embodiment of FIG. 10 shows a protruding member attached to only two connecting portions, the principles discussed here may also apply in cases where a protruding member is attached to three or more adjacent protruding members via three or more different connecting portions. In such cases, each of the three or more connecting portions may stretch to facilitate the displacement of a protruding member encountering an upward force.

Figure 11:
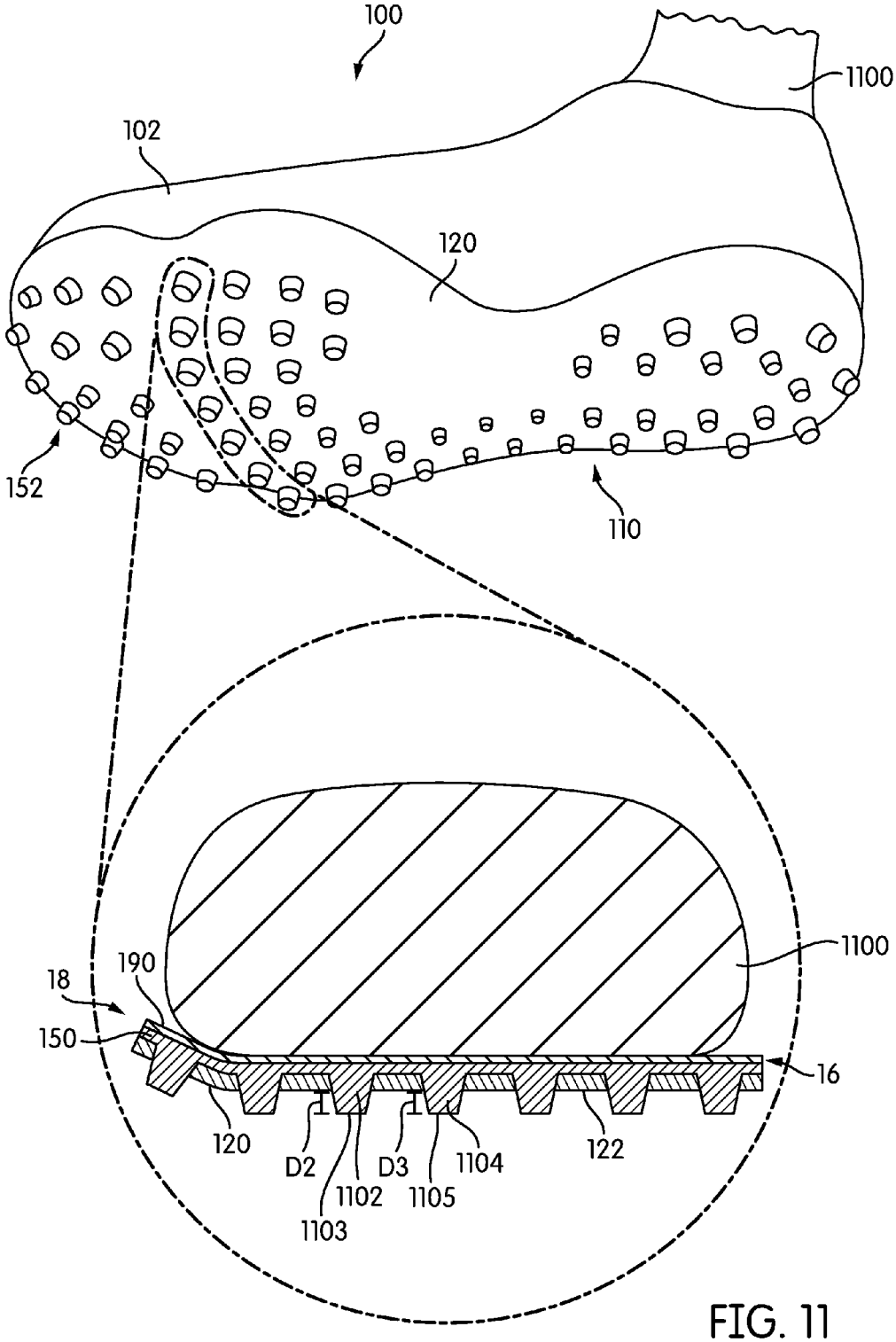
FIG. 11 is a schematic view of an embodiment of a sole system in a default configuration.
Figure 12:
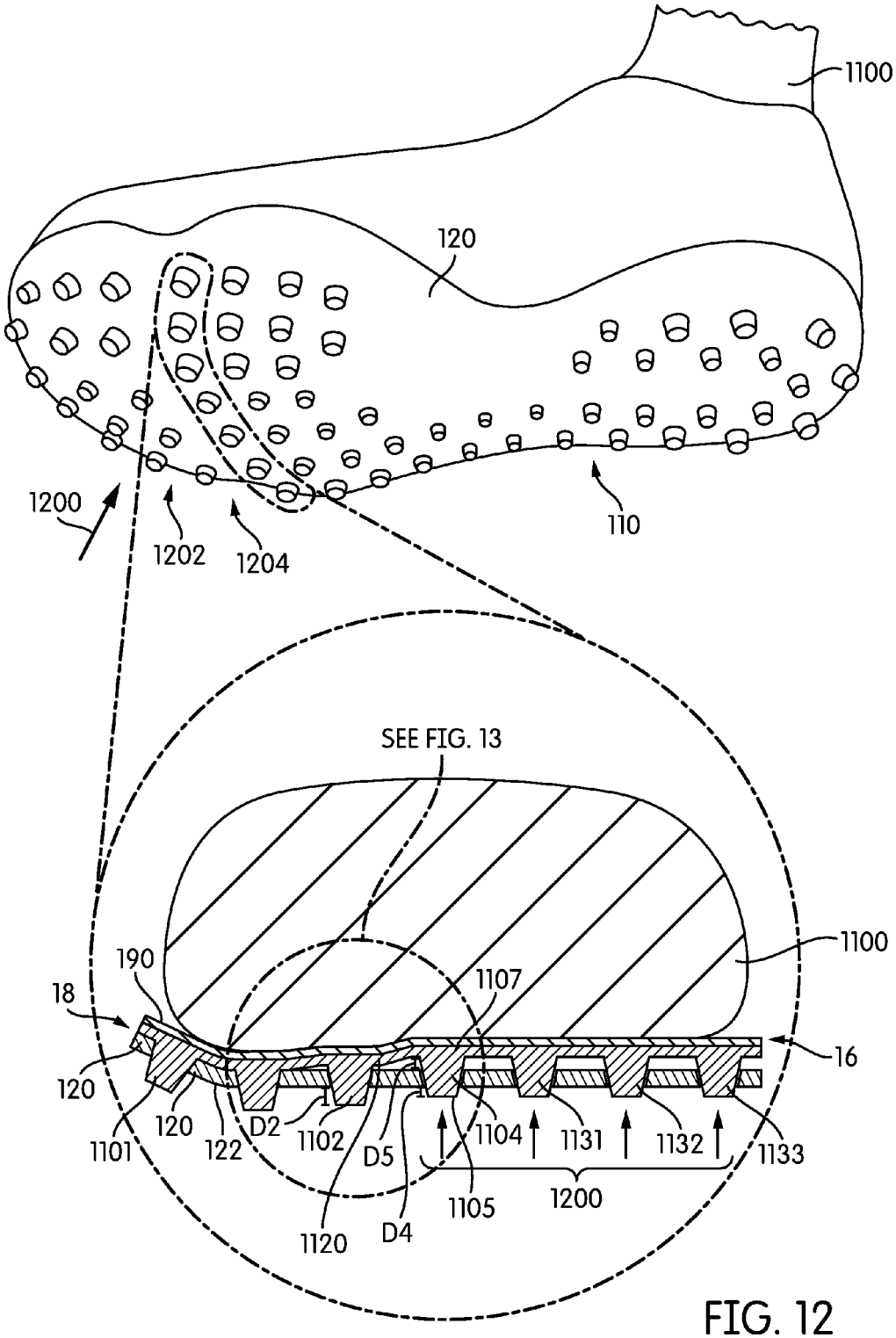
FIG. 12 is a schematic view of the sole system of FIG. 11 in an engaged configuration.

FIGS. 11 and 12 are schematic views of two configurations of sole system 110 that vary according to differences in applied forces. For purposes of illustration, each of FIGS. 11 and 12 shows an isometric bottom view of sole system 110 as well as an enlarged cross-sectional view of a portion of sole system 110. In each enlarged cross-section, portions of sole member 120, protruding member assembly 150 and inner member 190 are seen. Additionally, a foot 1100 is shown inserted within article 100.

As seen in FIG. 11, in which no forces are applied to the bottom of sole system 110, plurality of protruding members 152 are all fully extended from outwardly facing surface 122 of sole member 120. For example, a distal end portion 1103 of protruding member 1102 is extended a distance D2 from outwardly facing surface 122. Additionally, a distal end portion 1105 of protruding member 1104 is extended a distance D3 from outwardly facing surface 122. In this configuration, both protruding member 1102 and protruding member 1104 are seen to be fully extended. In this case, protruding member 1104 is disposed closer to medial side 18 of sole member 120 than protruding member 1102.

Referring next to FIG. 12, an exemplary force 1200 has been applied over a region 1202 of sole system 110, which is disposed on lateral side 16. Force 1200 acts to push a first group 1204 of protruding members into sole member 120. Specifically, as seen in FIG. 12, protruding member 1104 of first group 1204 is displaced so that distal end portion 1105 extends a distance D4 from outwardly facing surface 122. As seen by comparing FIG. 11 and FIG. 12, distance D4 may be substantially less than distance D3. Moreover, a proximal end portion 1107 of protruding member 1104 is raised above inwardly facing surface 124 by a distance D5 so that proximal end portion 1107 presses against inner member 190 and ultimately foot 1100. Likewise, protruding member 1131, protruding member 1132 and protruding member 1133 are seen to be similarly displaced in response to force 1200.

Because of the flexibility of protruding member assembly 150, movement of protruding members may primarily occur at localized regions where forces or pressures are directly applied. Thus, for example protruding member 1101, which is some distance away from region 1202 where force 1200 has been applied, does not move.

Figure 13:
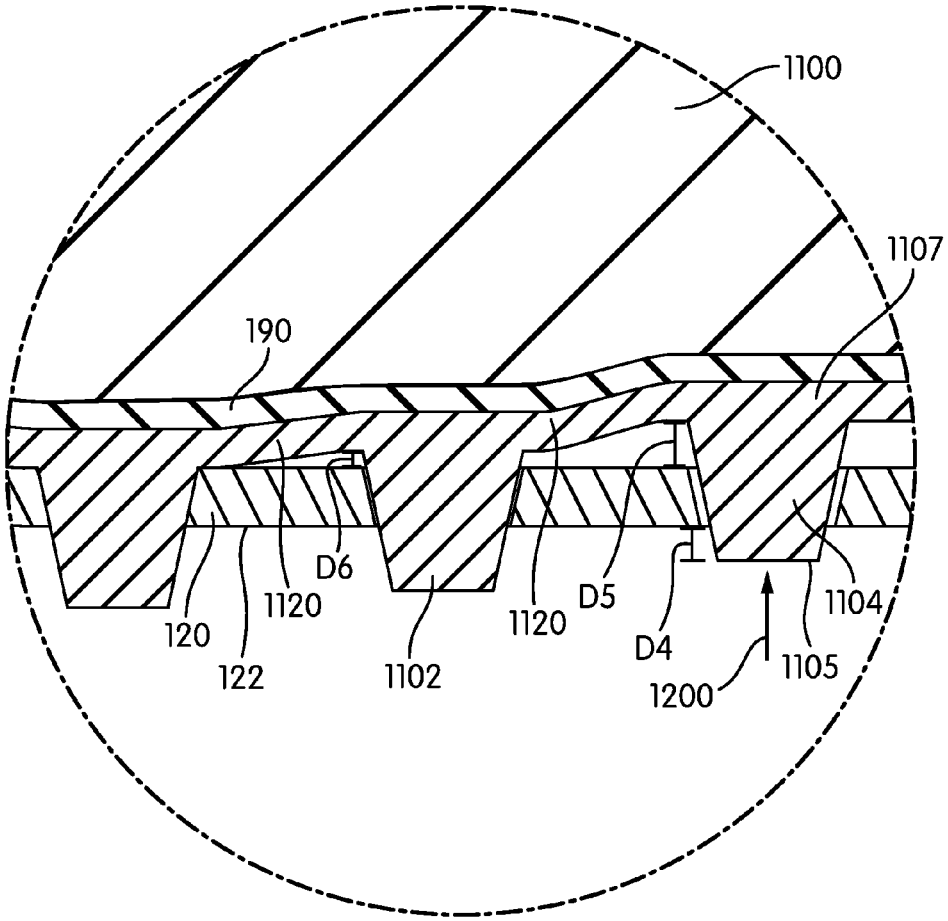
FIG. 13 is a schematic enlarged view of several protruding members of the sole system of FIG. 11 in an engaged configuration.

FIG. 13 shows a further enlarged view of protruding member 1102 and protruding member 1104. As previously discussed, protruding member 1104 and protruding member 1106 are displaced in the proximal direction by force 1200. In particular, protruding member 1104 is displaced a distance D5 from inwardly facing surface 124 of sole member 120. Although force 1200 is not directly applied to protruding member 1102, protruding member 1102 may still translate a small distance D6 due to tension from connecting portion 1120. However, because connecting portion 1120 is elastic and capable of stretching, protruding member 1102 is translated a lesser distance than protruding member 1104. In other words, distance D6 is substantially smaller than distance D5. The relative size of distance D5 and distance D6 could vary in different embodiments according to the material properties of connecting portion 1120. For example, in some cases, distance D6 may have a value be between 0 and 75 percent of the value of distance D5. In other embodiments, distance D6 could have a value greater than 75 percent of the value of distance D5.

The net effect of the change in configurations of protruding member assembly 150 shown in FIGS. 11-13 is that the protruding members within region 1202 where force 1200 has been applied, are translated in a proximal direction towards foot 1100. Thus, these protruding members, which include protruding member 1104, protruding member 1131, protruding member 1132 and protruding member 1133 provide tactile sensation to foot 1100 as they are displaced. This tactile sensation allows the user to sense the geometry of an underlying surface, in situations where the force is applied by a ground surface.

The local displacement of each protruding member in response to applied forces at their distal ends may result in a geometric configuration of protruding member assembly 150 that reflects the variation in applied forces. In particular, if sole system 110 is disposed on a contoured ground surface, the configuration of protruding member assembly 150 may be varied so that an inner surface of the protruding member assembly is provided with a contoured geometry that corresponds with the geometry of the contoured ground surface. With the foot in direct contact, or indirect contact, with the inner surface of protruding member assembly 150, the wearer of article 100 is able to sense the geometry of the underlying ground surface. In other words, sole system 110 creates a tactile sensation along the sole of the foot that provides the user with information about the ground surface.

Figure 14:
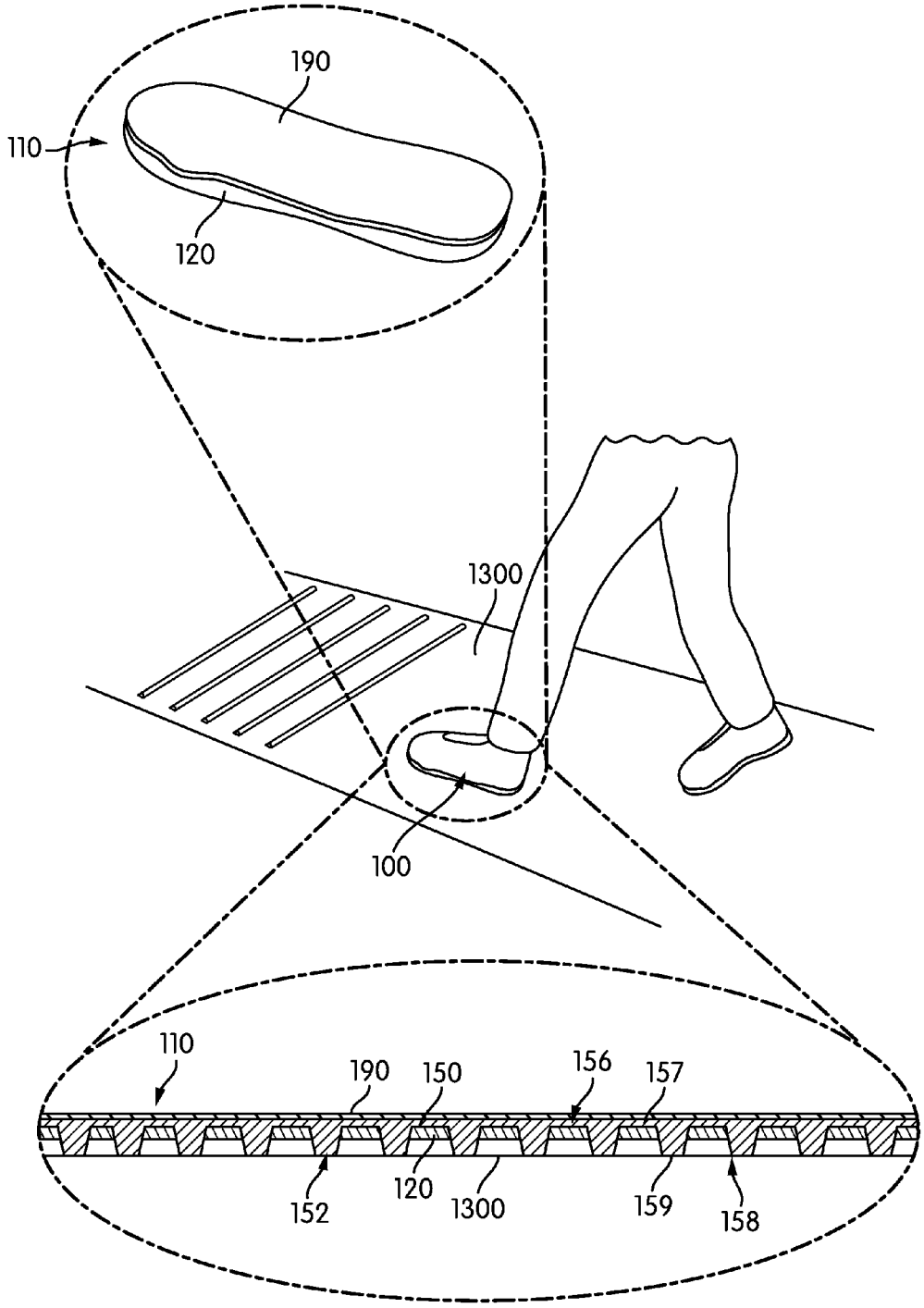
FIG. 14 is a schematic view of a sole system responding to a user walking on a substantially flat surface, according to an embodiment.
Figure 15:
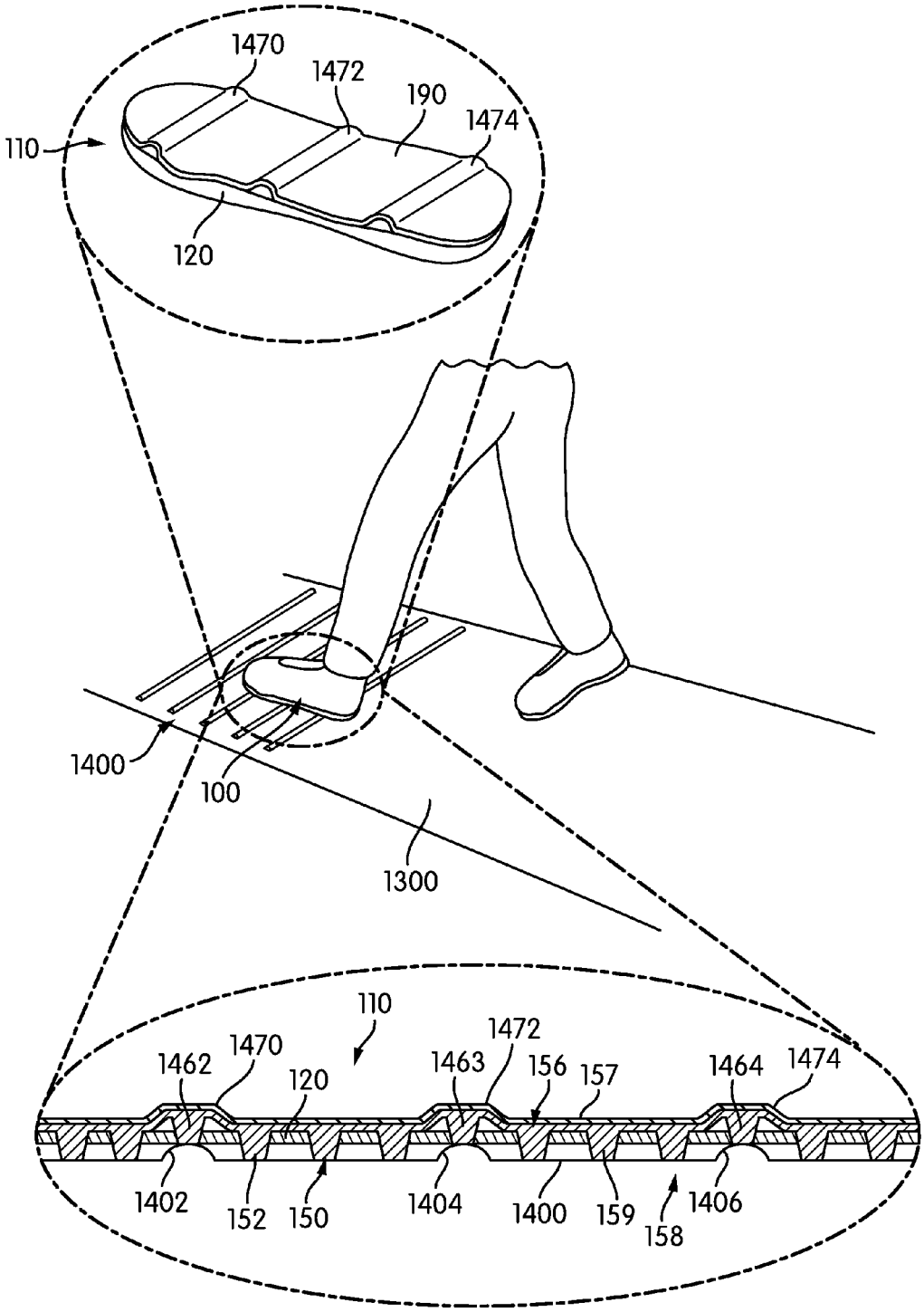
FIG. 15 is a schematic view of a sole system responding to a user walking on a contoured surface, according to an embodiment.
Figure 16:
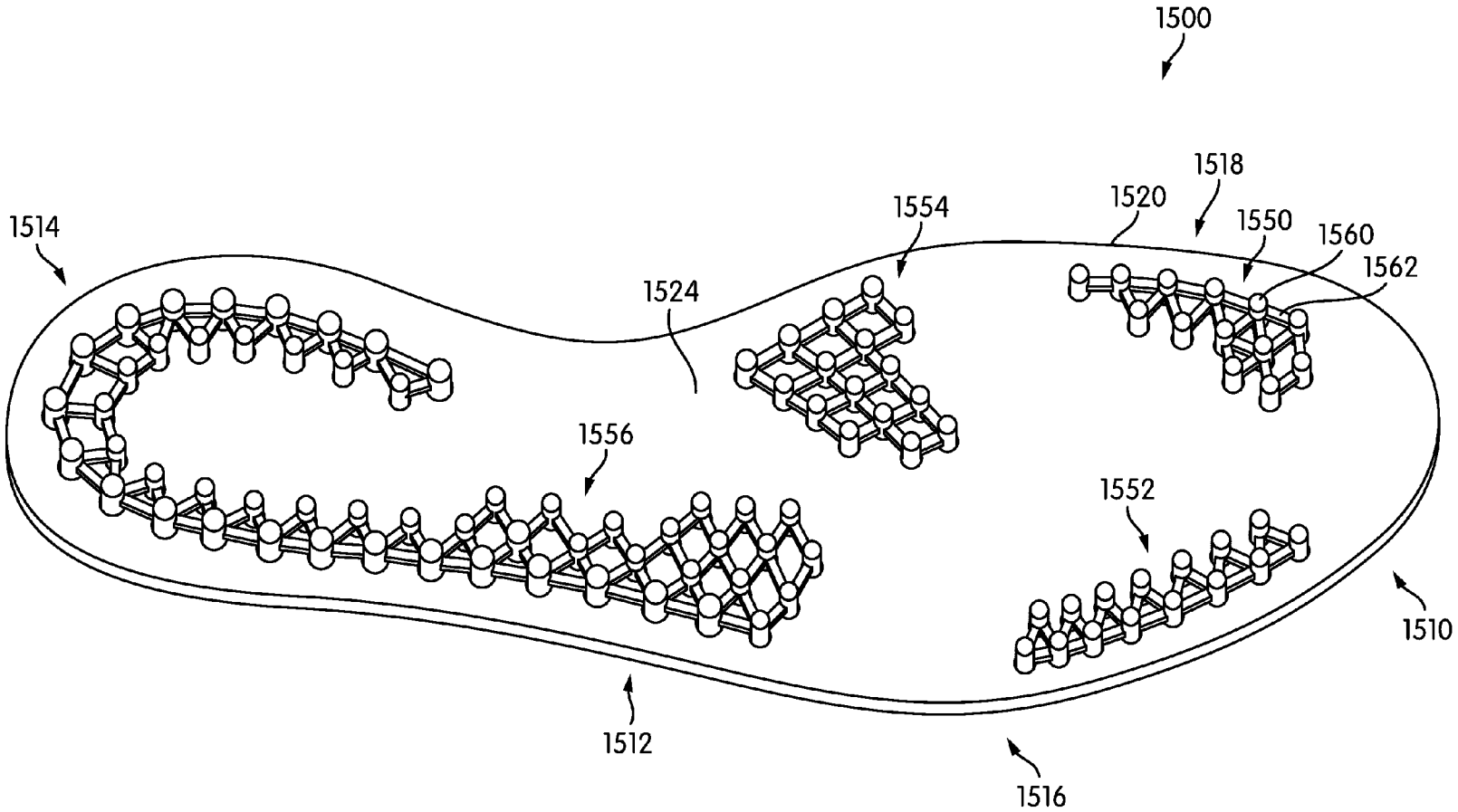
FIG. 16 is a schematic isometric view of another embodiment of a sole system, which includes multiple protruding member assemblies.
Figure 17:
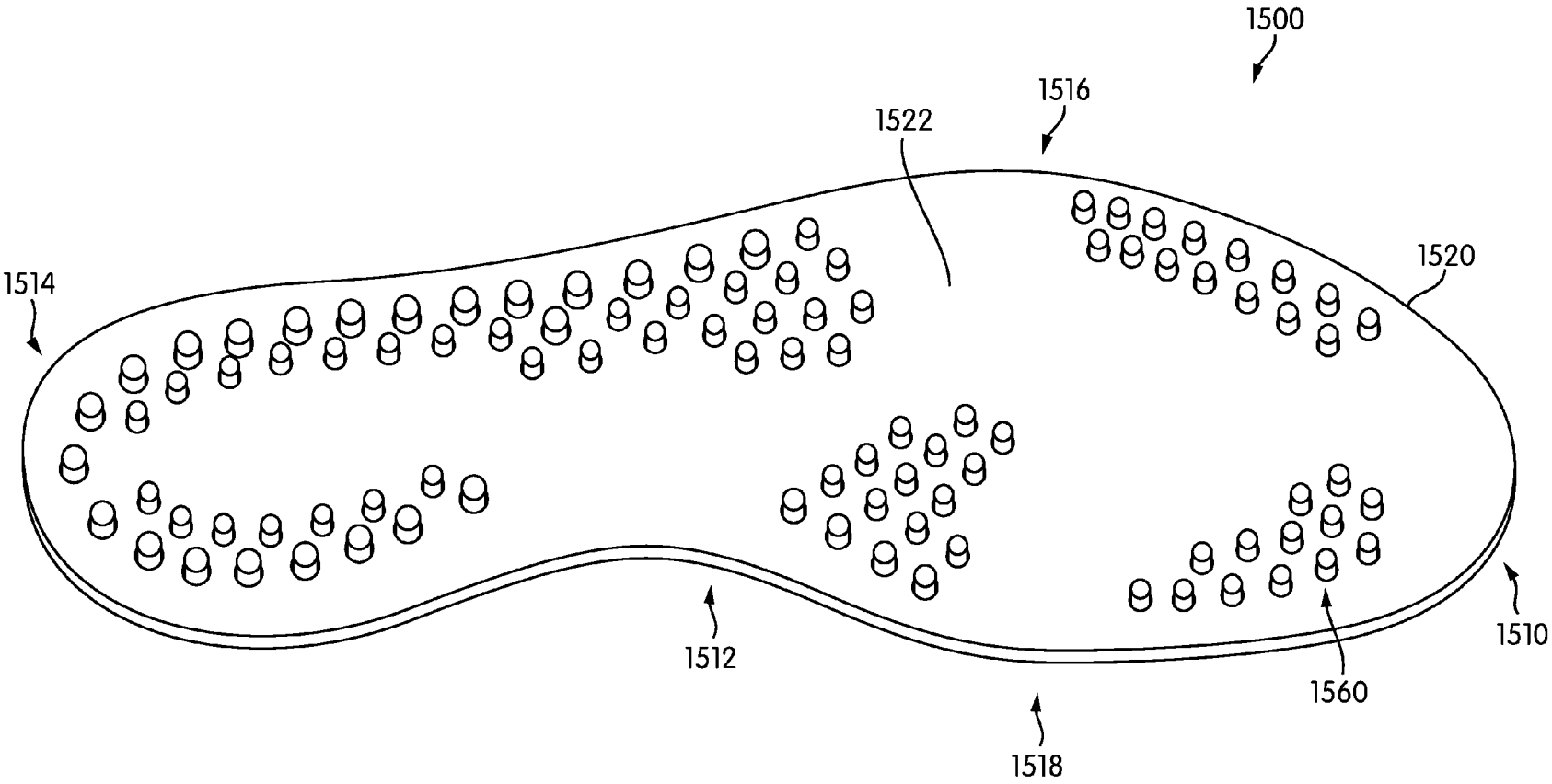
FIG. 17 is a schematic bottom isometric view of the sole system of FIG. 16.
Figure 18:
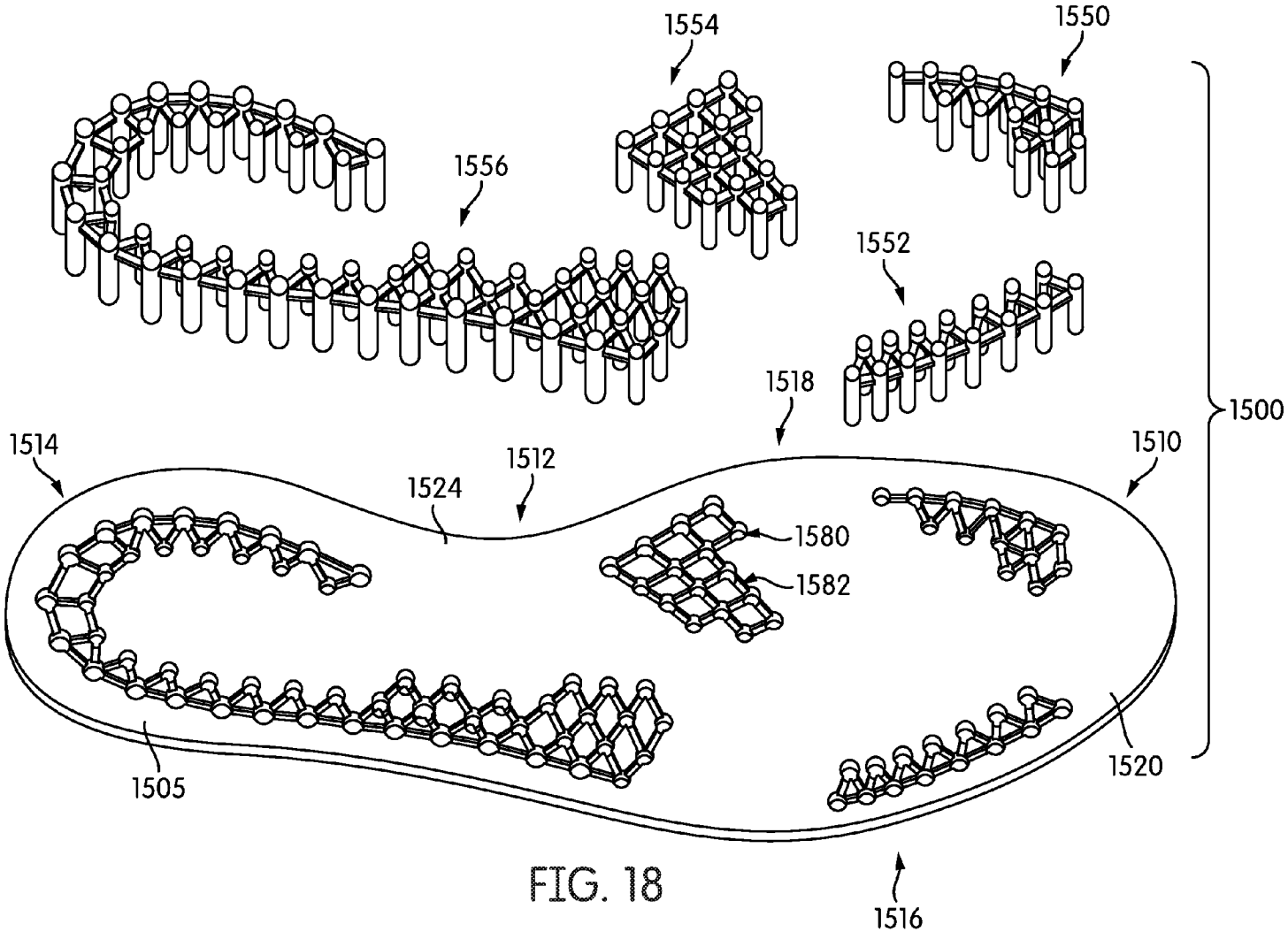
FIG. 18 is an exploded isometric view of the sole system of FIG. 16.

FIGS. 14 and 15 illustrates schematic views of an embodiment of article 100 in use. In particular, FIG. 14 illustrates a configuration where sole member 110 is engaged with a relatively flat surface, while FIG. 15 illustrates a configuration where sole member 110 is engaged with a contoured surface. As already mentioned, inner member 190, which is shown in FIGS. 14 and 15, is optional and may not be present in other embodiments.

Referring first to FIG. 14, article 100 is in contact with a relatively flat surface region 1300. In this configuration of sole system 110, plurality of protruding members 152 are all fully extended and in contact with flat surface region 1300. This results in a generally flattened outer surface 159 for outer portion 158 of protruding member assembly 150. Moreover, the flattened geometry of outer portion 158 results in a flattened inner surface 157 for inner portion 156 of protruding member assembly 150. Because inner member 190 is disposed over outer surface 157, inner member 190 is also seen to have an approximately flattened geometry. Thus, in this configuration a wearer's foot may rest on an approximately flat inner member 190, and/or directly on a flat outer portion 156 of protruding member assembly 150 (in cases where inner member 190 may not be used).

Referring now to FIG. 15, article 100 is in contact with a contoured surface region 1400. Specifically, contoured surface region 1400 includes a series of parallel ridge-like features, including first surface feature 1402, second surface feature 1404 and third surface feature 1406. As seen clearly in the enlarged cross-sectional view of sole system 110, sole system 110 engages the contoured surface and adapts accordingly. In particular, a first protruding member 1462, a second protruding member 1463 and a third protruding member 1464 are displaced by first surface feature 1402, second surface feature 1404 and third surface feature 1406, respectively. The remaining protruding members of plurality of protruding members 152 remain fully extended and in contact with flattened sections of contoured surface region 1400 that span between adjacent surface features. Thus, in this configuration of sole system 110, inner surface 157 of protruding member assembly 150 takes on a contoured geometry corresponding to the geometry of contoured surface region 1400. Moreover, as first protruding member 1460, second protruding member 1462 and third protruding member 1464 are retracted (or raised with respect to the other protruding members), inner surface 157 of protruding member assembly 150 also takes on a similar contoured geometry corresponding to the geometry of contoured surface region 1400. In embodiments where inner member 190 covers over protruding member assembly 150, the top surface of inner member 190 retains a similar geometry. Specifically, inner member 190 is provided with a contoured surface that includes a first surface feature 1470, a second surface feature 1472 and a third surface feature 1474.

As seen by comparing FIGS. 14 and 15, the geometry of sole member 120 may be substantially unchanged as protruding member assembly 150 undergoes elastic deformation. In an exemplary embodiment, sole member 120 comprises a member that is substantially more rigid than protruding member assembly 150. Sole member 120 may undergo little to no elastic deformation as sole system 110 comes into contact with a variety of different ground surfaces. In some embodiments, the rigidity of sole member 120 helps to provide consistent strength and support for the foot even as protruding member assembly 150 is elastically deformed in response to the underlying surface geometry.

Using the arrangement described above, a wearer of sole system 110 can sense surface features that might otherwise not be sensed using a traditional sole structure. Such an improvement in tactile sensation may enhance the wearer's balance, or could help the wearer to avoid undesirable ground conditions (e.g., bumpy surfaces or surfaces with divots).

FIGS. 16 through 20 illustrate various schematic views of another embodiment of components of a sole system 1500. Referring to FIGS. 16 through 20, sole system 1500 includes a sole member 1520. Sole member 1520 includes an outwardly facing surface 1522 and an inwardly facing surface 1524. Sole member 1520 may further include provisions for receiving protruding members and connecting portions. For example, sole member 1520 may include a plurality of holes 1580 for receiving protruding members as well as a plurality of recesses 1582 for receiving corresponding connecting portions (see FIG. 18).

As in a previous embodiment, sole system 1500 further includes protruding members connected by connecting portions. However, in contrast to the previous embodiments, the current embodiment may be characterized by the use of multiple different protruding member assemblies. For example, in the current embodiment, sole system 1500 incorporates a first protruding member assembly 1550, a second protruding member assembly 1552, a third protruding member assembly 1554 and a fourth protruding member assembly 1556.

Each protruding member assembly comprises a plurality of protruding members connected to one another by a plurality of connecting portions. For example, referring to FIG. 16, first protruding member assembly 1550 includes a first plurality of protruding members 1560 in which adjacent protruding members are connected by a first plurality of connecting portions 1562. Likewise, each of second protruding member assembly 1552, third protruding member assembly 1554 and fourth protruding member assembly 1556 are associated with protruding members attached via connecting portions.

The use of disjoint protruding member assemblies may allow for a variety of possible arrangements on sole member 1500. In the exemplary embodiment, first protruding member assembly 1550 and second protruding member assembly 1552 are associated with medial side 1518 and lateral side 1516 of forefoot portion 1510 of sole member 1500. Additionally, fourth protruding member assembly 1556 is associated with a rearward region of forefoot portion 1510, which is also on the medial side of sole member 1500. Finally, third protruding member assembly 1554 extends through heel portion 1514 of sole member 1500 as well as midfoot portion 1512 of sole member 1500. In some embodiments, third protruding member assembly 1554 is disposed along an outer peripheral portion 1505 of sole member 1500, and may not extend into a central portion 1506 of sole member 1500.

The exemplary configuration shown in FIGS. 16-20 provides a sole system where tactile sensation is provided at pre-determined regions. Such pre-determined regions could be selected to enhance tactile sensation at regions used in specific activities or motions. For example, first protruding member assembly 1550 and second protruding member assembly 1552 may be disposed on the medial and lateral edges of sole system 1500 so that a user may receive enhanced tactile sensations during lateral and medial cutting motions. Likewise, third protruding member assembly 1554 may be disposed in a region of sole member 1520 corresponding to the ball of the foot so that a user may receive enhanced tactile sensations during pivoting and/or turning motions. Finally, fourth protruding member assembly 1556 may be disposed in heel portion 1514 of sole member 1500 as well as on the lateral edge of the midfoot portion 1516 so that a user may receive enhanced tactile sensations while backpedaling.

Some embodiments may also include provisions to enhance the level of sensation provided by one or more protruding members to a foot. In some embodiments, for example, an end portion of a protruding member can extend above (or away from) an outward surface of a protruding member assembly. In the embodiment shown in FIGS. 16 through 20, connecting portions may be joined along the intermediate portions of the protruding members, which creates a protrusion that extends away from the connecting portions in the proximal and distal directions.

Figure 19:
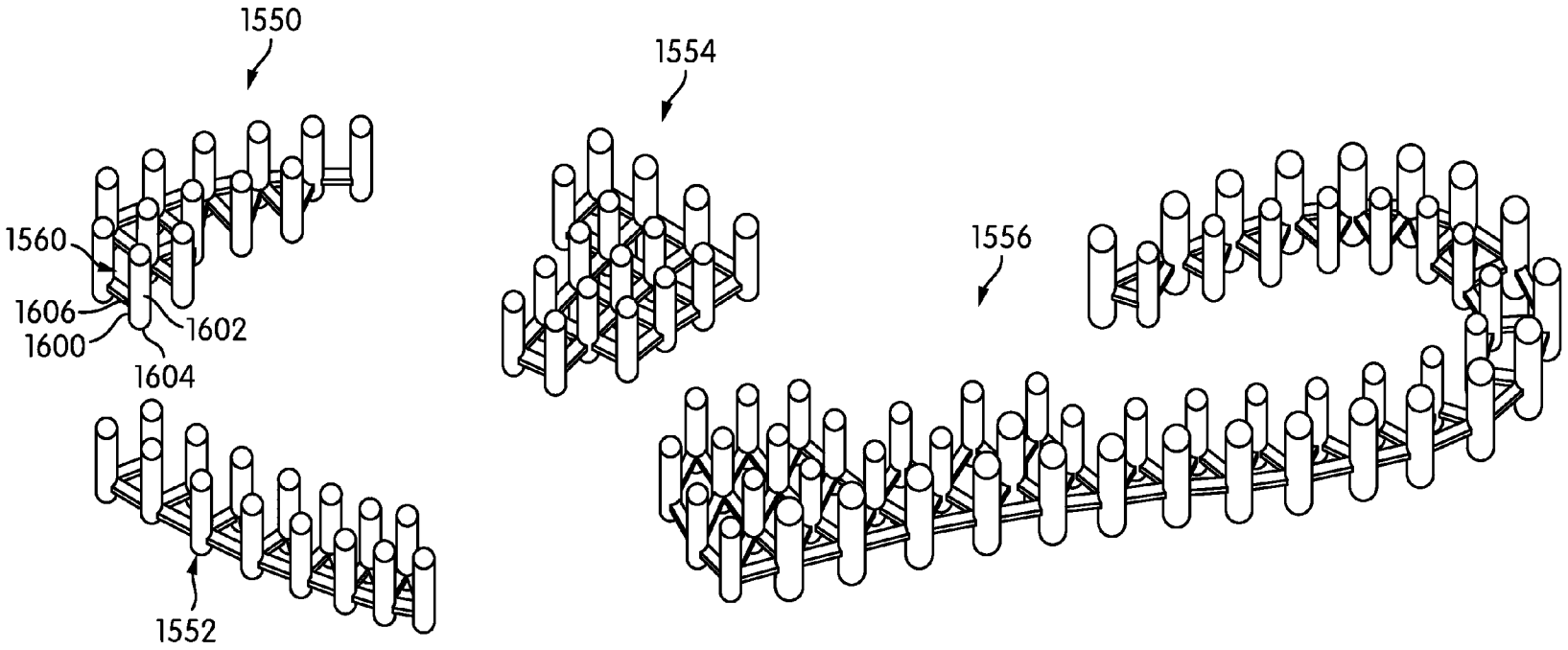
FIG. 19 is an isometric view of an outer side of the multiple protruding member assemblies of FIG. 16.
Figure 20:
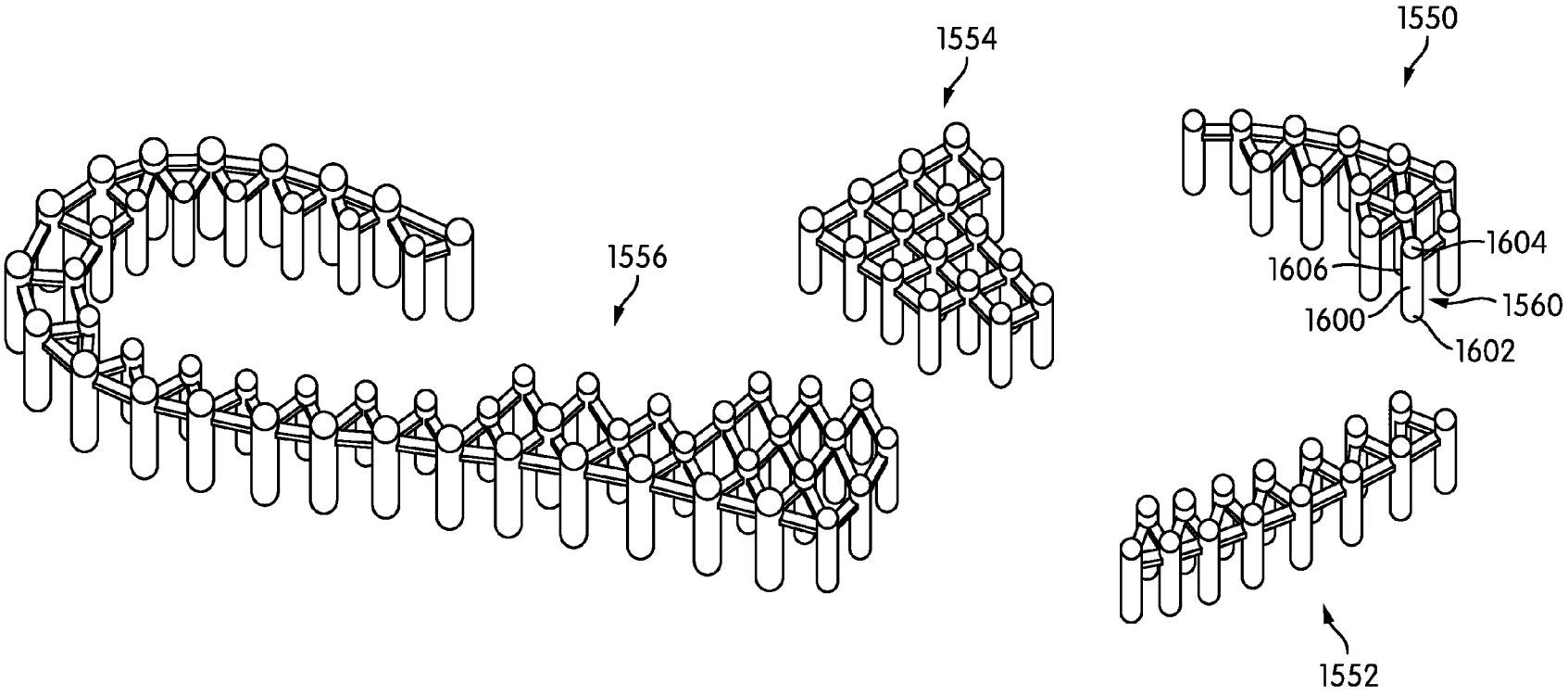
FIG. 20 is an isometric view of an inner side of the multiple protruding members assemblies of FIG. 16.

Referring now to FIGS. 19 and 20, in an exemplary embodiment, a protruding member 1600 of first protruding member assembly 1550 includes a distal protruding portion 1602 and a proximal protruding portion 1604, which are joined at an intermediate portion 1606 of protruding member 1600. In this case, intermediate portion 1606 is also where plurality of connecting portions 1560 are joined with protruding member 1600. Similarly, other protruding members of each protruding member assembly may include both distal and proximal protruding portions.

In different embodiments, the relative lengths of the proximal and distal protruding portions of a protruding member, as measured relative to the location where a connecting portion is joined to the protruding member, can vary. In some embodiments, for example, the distal protruding portion of a protruding member could be substantially longer than the proximal protruding portion. In other embodiments, the proximal protruding portion could be longer than the distal protruding portion. In still other embodiments, the proximal protruding portion could be substantially equal in length to the distal protruding portion. The relative length of the distal protruding portion and the proximal protruding portion could be varied to adjust characteristics of the sole system including the frequency and/or degree of tactile sensation provided by the sole system.

In contrast to the previous embodiments, the portion of a protruding member assembly engaging a foot is comprised mainly of proximal protruding portions of the protruding members. In other words, in this embodiment, plurality of connecting portions 1560 may not engage or otherwise contact a foot, or intermediate layer such as an inner member. Such a configuration for a protruding member assembly may change the amount of tactile sensation received at the foot, as the surface area of the contacting surface is less than in embodiments where connecting portions are also part of the contacting surface.

In some embodiments, a protruding member assembly may be formed as a substantially monolithic component. For example, in some embodiments, a protruding member assembly is a single molded construction comprising both connecting portions and protruding members. In other embodiments, however, a protruding member assembly could comprise protruding members that are pre-formed and then assembled together with connecting portions. In one embodiment, for example, a plurality of protruding members may be connected to one another by sections of elastic cable that are attached to the protruding members using an adhesive, a fastener or by tying the cables to the protruding members.

In some embodiments, protruding members and connecting portions could be made of substantially similar materials. For example, in embodiments where the protruding members and connecting portions comprise an integrally molded component, the protruding members and connecting portions could both be made of an elastically deformable material such as a plastic or rubber material. In other embodiments, protruding members and connecting portions could be made of substantially different materials. For example, in another embodiment, the protruding members could be constructed of a first material that is less elastic than a second material used to construct the connecting portions. Such a configuration would allow for increased flexibility of the connecting portions while limiting the elastic deformation undergone by the protruding members to maximize vertical force transfer. Moreover, the flexibility of the protruding members and the connecting portions could be varied to tune the protruding member assembly in order to achieve a desired level of tactile sensation during use.

In different embodiments, the materials used for a sole member could vary. In some embodiments, a sole member could be made of a rigid material that undergoes little deformation in response to ground contacting forces. For example, in some embodiments, a sole member could comprise a rigid plate. In other embodiments, the sole member could be somewhat flexible. For example, in another embodiment, a sole member could be made of a medium or hard foam that can deform somewhat in response to ground contacting forces. In an exemplary embodiment, the material used for the sole member may be more rigid and therefore undergo less bending, stretching, etc. than at least some components of the protruding member assembly.

Figure 21:
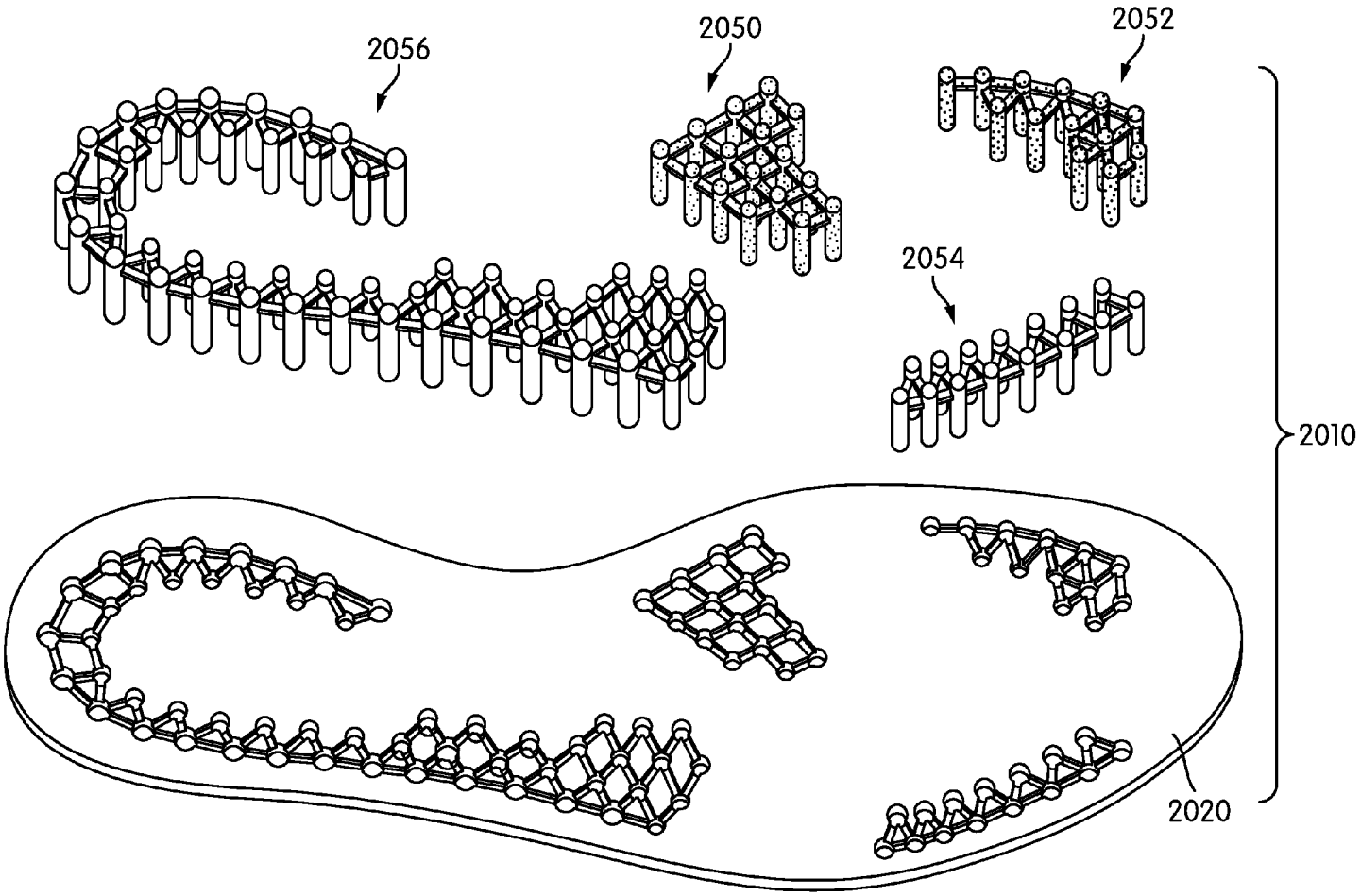
FIG. 21 is an isometric view of another embodiment of a sole system, in which different protruding member assemblies have different material properties.

FIG. 21 illustrates another embodiment of a sole system 2010. Sole system 2010 may be similar to the previous embodiment in some respects. For example, sole system 2010 includes a sole member 2020 and multiple protruding member assemblies. An optional inner member (not shown) could also be included in some embodiments.

In this embodiment, a first protruding member assembly 2050, a second protruding member assembly 2052, a third protruding member assembly 2054 and a fourth protruding member assembly 2056 may be provided to enhance tactile sensation in the manner described above. In some embodiments, the material construction of two or more protruding member assemblies could be different. For example, in this embodiment first protruding member assembly 2050 is made of a first material, second protruding member assembly 2052 is made of a second material, and both third protruding member assembly 2054 and fourth protruding member assembly 2056 are made of a third material. Here, the first material, the second material and the third material are all substantially different.

Each of the first material, the second material and the third material could vary in one or more material characteristics. For example, in some cases, the first material may be substantially more elastic than the second material. Likewise, the second material could be substantially more elastic than the third material. Thus, with this configuration, first protruding member assembly 2050 may more readily deform in response to ground forces than second protruding member assembly 2052. Likewise, both first protruding member assembly 2050 and second protruding member assembly 2052 may more readily deform in response to ground forces than either third protruding member assembly 2054 or fourth protruding member assembly 2056. Thus, sole system 2010 may be more responsive (i.e., may provide more tactile sensation) to motions such as pivoting and medial cutting, than lateral cutting or back pedaling.

Although the embodiment of FIG. 21 illustrates a sole system with disjoint (i.e., completely separated) protruding member assemblies made of different materials, in another embodiment a unitary protruding member assembly could comprise regions of different materials and/or material properties.

In some embodiments, the type and degree of tactile sensation experienced by a wearer may be a function of the density and size of the protruding members. As the size of the protruding members is decreased and their density increased, the resolution of tactile sensations is increased. In other words, with more protruding members that are more densely packed together, the protruding member assembly may be used to sense finer geometric structures in the underlying ground surface. Therefore, while the exemplary embodiments depict some possible combinations of protruding member size and spatial density, in other embodiments the protruding member size and spatial density could be adjusted to achieve a desired resolution in tactile sensation provided to the wearer.

FIGS. 22-29 depict various alternative embodiments of a sole system or components of a sole system. It should be understood that the various features described and shown in FIGS. 22-29 can be incorporated into any of the embodiments discussed herein.

FIG. 22 illustrates an exemplary embodiment of an article of footwear 2200 that may be similar in at least some respects to the embodiment discussed above and shown in FIG. 2. Referring to FIG. 22, article 2200 includes an upper 2202 and a sole system 2210. Sole system 2210 may be further comprised of a sole member 2220 and a protruding member assembly 2250.

However, in contrast to previous embodiments, the embodiment of FIG. 22 specifically depicts a configuration in which a foot 2290 comes into direct contact with a proximal surface 2230 of protruding member assembly 2250. In some embodiments, portions of foot 2290 may also directly contact sole system 2210. In other words, the embodiment of FIG. 22 lacks an insole, liner or other layer that separates foot 2290 and protruding member assembly 2250. Such a configuration may provide increased tactile sense along the bottom of the foot.

Figure 23:
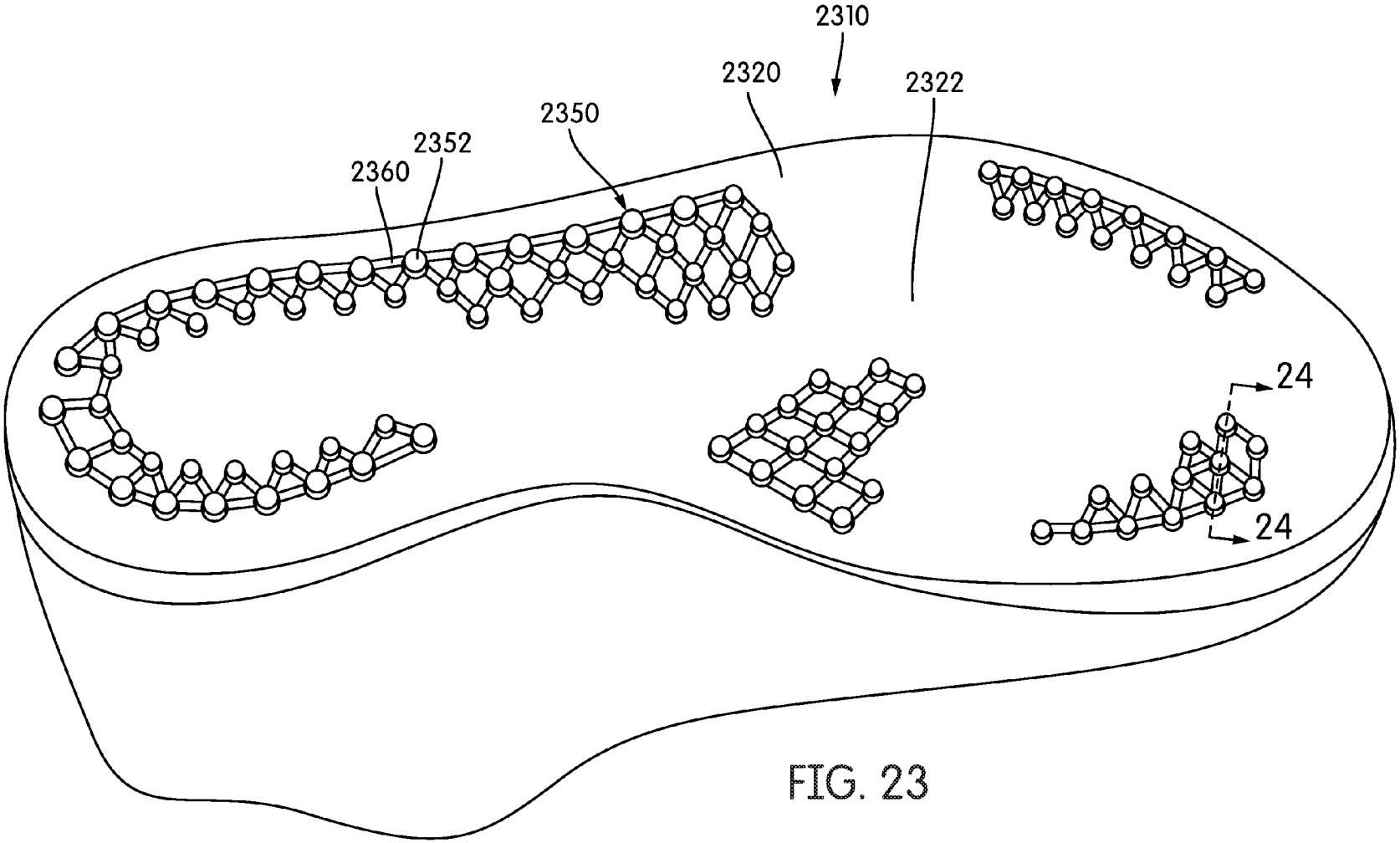
FIG. 23 is a bottom isometric view of an embodiment of a sole system, in which a protruding member assembly includes connecting portions disposed externally on the sole system.
Figure 24:
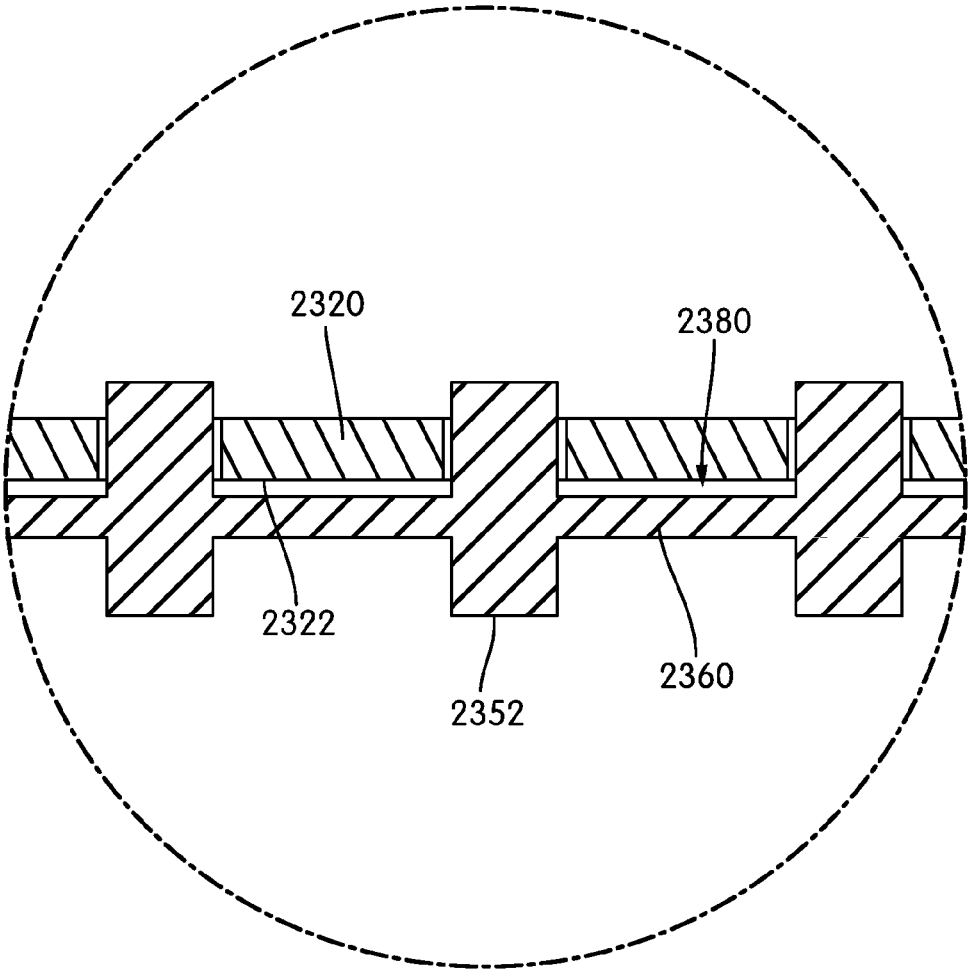
FIG. 24 is a schematic cross-sectional view of a portion of the sole system shown in FIG. 23.
Figure 25:
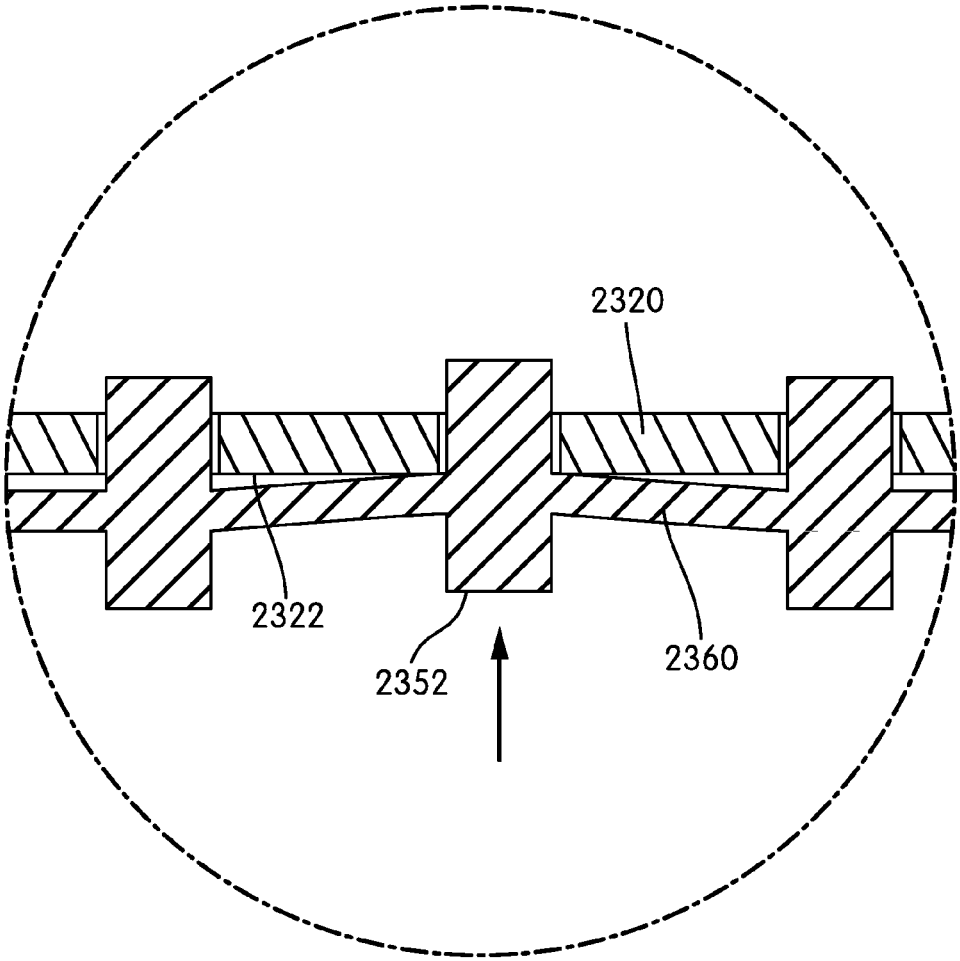
FIG. 25 is a schematic cross-sectional view of a portion of the sole system shown in FIG. 23, in which the protruding member assembly has been depressed.

FIGS. 23-25 illustrate another embodiment for a sole assembly with a protruding member assembly. Referring first to FIG. 23, a sole system 2310 is comprised of a sole member 2320 and a plurality of protruding member assemblies 2350. Moreover, in some embodiments, plurality of protruding member assemblies 2350 may be arranged so that plurality of connecting portions 2360 are disposed on a distal side 2322 of sole member 2320. In other words, plurality of connecting portions 2360 may be exposed on an outer surface of a sole system, rather than being disposed internally to the sole system.

FIGS. 24 and 25 depict a schematic side cross-sectional view of a portion of sole system 2310. As seen in FIGS. 24-25, forces applied to protruding members 2352 may cause at least some protruding members 2352 to be retracted within sole member 2320. In some embodiments, the amount that protruding members 2352 may retract into sole member 2320 may depend on the default (i.e., non-stressed) separation 2380 (see FIG. 24) between plurality of connecting portions 2360 and distal surface 2322 of sole member 2320. Additional factors that may affect the degree of retraction include, but are not limited to: the sizes of the holes, elasticity of connecting portions and/or protruding members as well as possibly other factors.

Figure 26:
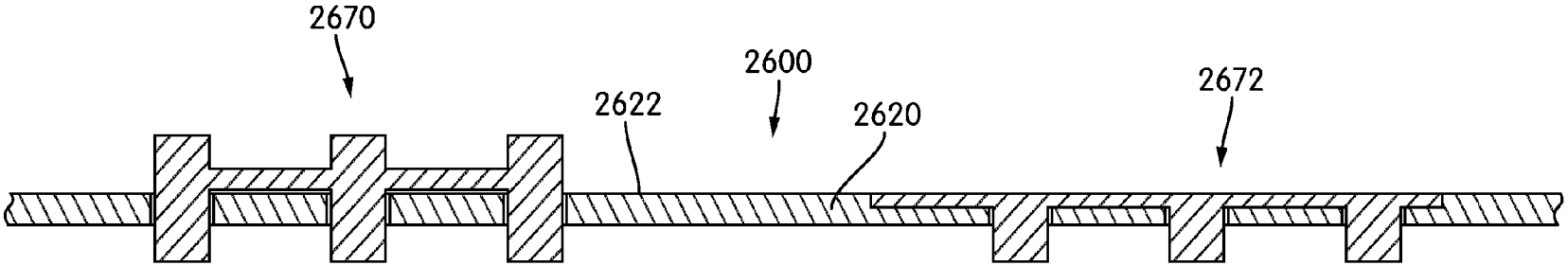
FIG. 26 is a schematic cross-sectional view of a portion of a sole system including a protruding member assembly that is flush with an inner sole surface, according to an embodiment.

In different embodiments, the degree to which portions of a protruding member assembly are raised above a proximal surface of a sole member can vary. FIG. 26 depicts a partial cross-sectional view of an embodiment of a sole system 2600 with various configurations for protruding member assemblies with respect to a proximal surface 2622 of a sole member 2620. In particular, first protruding member assembly 2670 is raised above proximal surface 2622. In contrast, second protruding member assembly 2672 is seen to be approximately flush with proximal surface 2622. In still other embodiments, some or all of a protruding member assembly could be recessed with respect to proximal surface 2622 (i.e., proximal surface 2622 could be closer to a foot than the protruding member assembly in a non-stressed configuration). By varying the degree to which various protruding member assemblies (or their components) are raised or recessed with respect to a proximal side of a sole member, an article can be tuned to accommodate the degree of pressure applied to different portions of a foot by protruding member assemblies. For example, in the example embodiment depicted in FIG. 26, first protruding member assembly 2670 applies pressure at a corresponding portion of a foot even without substantial forces applied by a ground surface. In contrast, the flush configuration for second protruding member assembly 2672 provides little pressure at a corresponding portion of the foot when sole system 2600 is not in contact with a ground surface. Thus, the degree of pressure applied by different protruding member assemblies at different locations of the foot can be tuned to achieve desirable tactile sensations.

As discussed above, protruding members in a protruding member assembly can be joined, or otherwise associated, with one another using a variety of structures. In some embodiments, protruding members may be integrally formed with connecting portions, which can be accomplished using various kinds of molded polymer materials. In other embodiments, however, connecting portions could comprise a variety of different materials as well as possibly different structures to achieve the desired degree of relative flexibility between protruding members.

Figure 27:
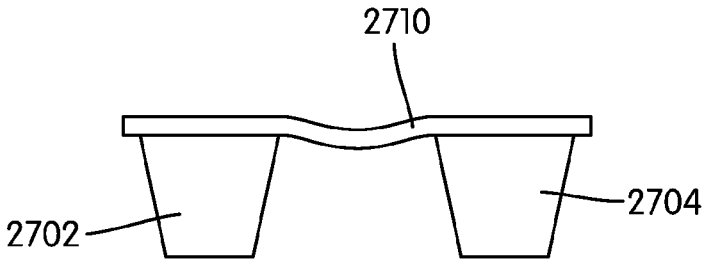
FIG. 27 is a side schematic view of an embodiment of two protruding members connected by a fabric connecting portion.

FIG. 27 is a schematic side view of an embodiment of several components that could comprise a portion of a larger protruding member assembly. Referring to FIG. 27, a first protruding member 2702 may be joined to a second protruding member 2704 by a connecting portion 2710. In this exemplary embodiment, connecting portion 2720 may comprise a textile material, for example: any kinds of woven or non-woven fabrics. In some embodiments, the textile material used for connecting portion 2720 may have some elasticity. However in other embodiments the material may not be substantially elastic.

Figure 28:
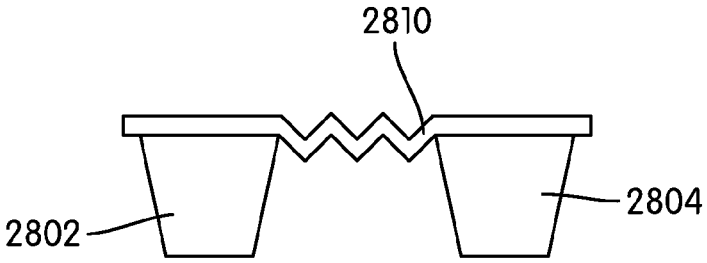
FIG. 28 is a side schematic view of an embodiment of two protruding members connected by a connecting portion with a bellowed geometry.
Figure 29:
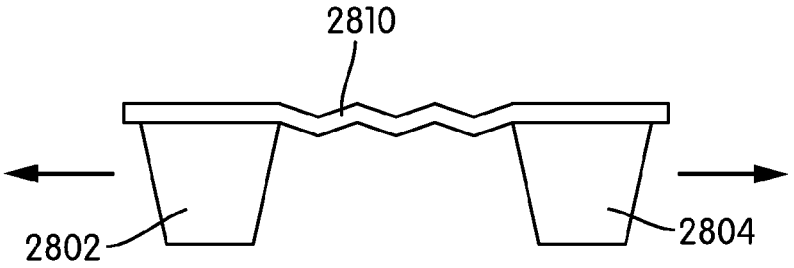
FIG. 29 is a side schematic view of the protruding members of FIG. 28, in which the protruding members are pulled apart by expanding the bellowed geometry of the connecting portion.

It is also contemplated that in some embodiments protruding members could be attached using structures that incorporate a living hinge and/or bellows structure. For example, FIGS. 28 and 29 depict default and stretched configurations, respectively, of components of a protruding member assembly. Referring to FIG. 28, first protruding member 2802 and second protruding member 2804 may be joined by bellowed connecting portion 2810. In particular, bellowed connecting portion 2810 has a bellowed geometry that allows first protruding member 2802 and second protruding member 2804 to separate by a predetermined amount, as shown in FIG. 29. In some embodiments, the bellowed geometry of one or more connecting portions can be selected to achieve a desired degree of stretching between adjacent protruding members under a predetermined force.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

a sole member having an outwardly facing surface and an inwardly facing surface disposed opposite of the outwardly facing surface, wherein the outwardly facing surface is adapted to be disposed further from a foot than the inwardly facing surface when the article of footwear is worn;

a first protruding member assembly comprising a first plurality of protruding members and a first plurality of connecting portions;

a second protruding member assembly comprising a second plurality of protruding members and a second plurality of connecting portions;

the first plurality of protruding members including a first protruding member and a second protruding member;

the second plurality of protruding members including a third protruding member and a fourth protruding member;

the first protruding member assembly further including a first connecting portion including a first end portion attached to the first protruding member and a second end portion attached to the second protruding member;

the sole member including a first hole and a second hole; and the first protruding member extending through the first hole and the third protruding member extending through the second hole, wherein the first protruding member has a first position wherein a proximal end portion of the first protruding member is disposed a first distance from the inwardly facing surface of the sole member, wherein the first protruding member has a second position wherein the proximal end portion of the first protruding member is disposed a second distance from the inwardly facing surface of the sole member, and wherein the second distance is greater than the first distance.

2. The article of footwear according to claim 1, wherein the inwardly facing surface of the sole member includes a first plurality of recesses that are sized and oriented to receive the first plurality of connecting portions.

3. The article of footwear according to claim 1, wherein the first connecting portion is disposed in a first recess formed in the inwardly facing surface of the sole member, the first recess having an elongated strip-like shape.

4. The article of footwear according to claim 1, wherein the first protruding member assembly and the second protruding member assembly have different material properties.

5. The article of footwear according to claim 1, the second protruding member assembly further including a second connecting portion including a third end portion attached to the third protruding member and a fourth end portion attached to the fourth protruding member.

6. An article of footwear, comprising:

a sole member having an outwardly facing surface and an inwardly facing surface disposed opposite of the outwardly facing surface, wherein the outwardly facing surface is adapted to be disposed further from a foot than the inwardly facing surface when the article of footwear is worn;

a plurality of protruding members, each of the plurality of protruding members including a proximal end portion and a distal end portion, wherein the distal end portion is adapted to be disposed further from the foot than the proximal end portion when the article of footwear is worn;

the plurality of protruding members comprising at least a first protruding member, a second protruding member, and a third protruding member;

the first protruding member being disposed between the second protruding member and the third protruding member;

a first connecting portion including a first end portion attached to the first protruding member and a second end portion attached to the second protruding member;

a second connecting portion including a third end portion attached to the first protruding member and a fourth end portion attached to the third protruding member;

wherein the first connecting portion and the second connecting portion have different material properties, wherein the first protruding member has a first position wherein the proximal end portion of the first protruding member is disposed a first distance from the inwardly facing surface of the sole member, wherein the first protruding member has a second position wherein the proximal end portion of the first protruding member is disposed a second distance from the inwardly facing surface of the sole member, and wherein the second distance is greater than the first distance.

7. The article of footwear of claim 6, wherein the first connecting portion comprises a textile material.

8. The article of footwear of claim 6, wherein the first connecting portion has a bellowed geometry that allows the first protruding member and the second protruding member to separate by a predetermined amount.

9. The article of footwear of claim 6, wherein the first connecting portion has a first length when the first protruding member is in the first position and a second length when the first protruding member is in the second position, wherein the second length is greater than the second length.

* * * * *